US011826625B1

(12) United States Patent
Sepahpour et al.

(10) Patent No.: US 11,826,625 B1
(45) Date of Patent: Nov. 28, 2023

(54) GOLF CLUB SWING TRAINING DEVICE

(71) Applicant: FBJ Enterprises, LLC, Moorestown, NJ (US)

(72) Inventors: Bijan Sepahpour, Pennington, NJ (US); Francis M. Brown, Verona, NJ (US); John Coughlin, Moorestown, NJ (US)

(73) Assignee: FBJ Enterprises, LLC, Moorestown, NJ (US)

( * ) Notice: Subject to any disclaimer, the term of this patent is extended or adjusted under 35 U.S.C. 154(b) by 0 days.

(21) Appl. No.: 17/880,324

(22) Filed: Aug. 3, 2022

(51) Int. Cl.
*A63B 69/36* (2006.01)
*A63B 69/00* (2006.01)
*A63B 102/32* (2015.01)

(52) U.S. Cl.
CPC ..... *A63B 69/0059* (2013.01); *A63B 2102/32* (2015.10); *A63B 2209/08* (2013.01)

(58) Field of Classification Search
CPC ..... A63B 69/0059; A63B 2102/32; A63B 2209/08
USPC .... 473/62, 63, 207, 212, 214, 447, 448, 450
See application file for complete search history.

(56) References Cited

U.S. PATENT DOCUMENTS 2,468,580 A * 4/1949 Weis ..... A63B 69/0059 473/214
3,288,468 A * 11/1966 Cunningham ..... A63B 69/0059 473/214
3,339,926 A 9/1967 Coupar
3,970,305 A * 7/1976 Hawkins ..... A63B 71/14 473/62
4,476,857 A 10/1984 Levine
4,504,054 A 3/1985 Jackson et al.
4,605,227 A 8/1986 Hurd et al.
(Continued)

FOREIGN PATENT DOCUMENTS

WO 00/06262 A1 2/2000

OTHER PUBLICATIONS

"Keep It Straight™," Golf Around the World, Inc., w3ihscnet.commercebox.com, Mar. 2, 2015, 1 p., https://w3ihscnet.commercebox.com/~golfarou/product_info.php?products_id=289& SESS=i9ti40tf8ljdn553d4tfci3e44.
(Continued)

*Primary Examiner* — Nini F Legesse
(74) *Attorney, Agent, or Firm* — KAPLAN BREYER SCHWARZ, LLP

(57) ABSTRACT

A golf swing training device includes a sleeve or strap arrangement to be worn about the elbow of a golfer's leading arm and an elbow bracing assembly attached to or integrated with the sleeve or strap arrangement. The elbow bracing assembly includes pivotally connected first and second brace members and a lock bar slidable within the first and second brace members between a locked position and an unlocked position. The lock bar in the locked position substantially prevents pivotal movement of the first and second brace members, thereby preventing bending of the elbow of the leading arm during a back-swing and down-swing portions of a golf swing. The lock bar in the unlocked position allows pivotal movement of the first and second brace members, thereby allowing the device to bend with bending of the elbow of the leading arm during an up-swing portion of the golf swing.

19 Claims, 18 Drawing Sheets

(56) References Cited

U.S. PATENT DOCUMENTS

| | | | | |
|---|---|---|---|---|
| 4,682,776 | A * | 7/1987 | Mitchell | A63B 23/1281 403/111 |
| 4,911,728 | A | 3/1990 | Rigel | |
| 5,048,837 | A | 9/1991 | Manley et al. | |
| 5,069,457 | A | 12/1991 | Korzenowski | |
| 5,174,575 | A | 12/1992 | Leith et al. | |
| 5,401,017 | A | 3/1995 | McDonald et al. | |
| 5,445,385 | A | 8/1995 | Brooks | |
| 5,472,206 | A | 12/1995 | Manley et al. | |
| 5,704,846 | A | 1/1998 | Johnson | |
| 5,743,806 | A | 4/1998 | Brennan | |
| 7,156,748 | B2 | 1/2007 | Burke | |
| 7,658,681 | B1 * | 2/2010 | Malecha | A63B 69/3608 473/214 |
| 7,789,763 | B1 | 9/2010 | Smith | |
| 8,043,163 | B2 | 10/2011 | Proplesch | |
| 11,077,348 | B1 * | 8/2021 | Stokke | A63B 69/0059 |
| 2010/0190564 | A1 | 7/2010 | Lindby | |
| 2014/0171212 | A1 | 6/2014 | Curry | |
| 2019/0201767 | A1 * | 7/2019 | Wicoff | A63B 69/0059 |

OTHER PUBLICATIONS

"New Golf Swing Training Straight Practice Aids Golf Elbow Brace Arc Support Band," Ebay, ebay.com, Seller: dreamholic75, Oct. 6, 2014, 7 pp., http://www.ebay.com/itm/New-Golf-Swing-Training-Straight-Practice-Aids-Golf-Elbow-Brace-Arc-Support-Band-/251162131300.

Golf Swing Training Aids Arm Band Elbow Balance, DX dealextreme, dx.com, SKU: 114643, copyright 2006-2015, 3 pp., http://www.dx.com/p/golf-swing-training-aids-arm-band-elbow-balance-114643#.VPR2e_nF8tE.

Richie3Jack, "Right Arm Folding and Over-Folding," 3Jack Golf Blog, 3jack.blogspot.com, Dec. 1, 2010, 8 pp., http://3jack.blogspot.com/20 0/ 2/right-arm-folding-and-over-folding.html.

* cited by examiner

GOLF CLUB SWING TRAINING DEVICE

FIELD

This invention relates to golfing accessories, and more particularly to a golf swing training device to prevent the golfer from bending the elbow of the leading arm during the golf swing.

BACKGROUND

One of the most popular sports in the country today is golf. One reason for its popularity is that most anyone can play golf because of the use of handicaps and the like. Therefore, less skilled golfers can play against more skilled golfers while still enjoying the game. Another reason for its popularity is due to advances in golf club and golf ball technology, which has made golf easier and more enjoyable to play. These advances allow less skilled golfers to hit golf balls greater distances and with more accuracy than previously.

It is well known in golf that when a golfer swings a wood or a long iron golf club, the golfer should maintain a straight leading arm (unbent elbow) during the back-swing and down-swing portions of the golf swing. After making contact with the golf ball, and as the golfer enters the up-swing portion of the golf swing, the golfer should be able to bend the elbow of the leading arm in follow-through.

Unfortunately, many less skilled golfers tend to bend the leading arm during the back-swing and/or down-swing portions of the golf swing. The bending of the leading arm undesirably produces inaccurate and shorter distance golf shots. Even when golfers attempt to maintain a straight leading arm during the back-swing and down-swing portions of the golf swing, many golfers still have a tendency to unknowingly bend the leading arm just as the golf ball is struck, thereby still producing inaccurate and shorter distance golf shots.

Accordingly, a golf swing training device is needed, which enables the golfer to develop muscle memory for maintaining the golfer's leading arm in a substantially straight position during the back-swing and down/forward-swing portions of the golf swing, and which allows the leading arm to bend at the elbow during the up-swing/follow-through portion of the golf swing, which does not cause any harm to the arm of the golfer, and reset the device intuitively for any additional trials.

SUMMARY

Disclosed herein is a golf swing training device. In various embodiments, the golf swing training device comprises a sleeve or strap arrangement to be worn about the elbow of a leading arm of the golfer and an elbow bracing assembly attached to or integrated with the sleeve or strap arrangement. The elbow bracing assembly comprises first and second brace members pivotally connected with a hinge in a hinge area defined by the first and second brace members and a lock bar slidable within at least a portion of the first and second brace members between a locked position and an unlocked position. The lock bar in the locked position, extends across the hinge area and having a first portion disposed within the first brace member and a second portion disposed within the second brace member, thereby substantially preventing pivotal movement of the first and second brace members, and the lock bar in the unlocked position completely disposed within the second brace member. The lock bar in the locked position, allows the device to stay substantially unbent, thereby substantially preventing bending of the elbow of the leading arm during a back-swing and down-swing portions of a golf swing and the lock bar of the elbow bracing assembly in the unlocked position, allows the device to bend with bending of the elbow of the leading arm during an up-swing portion of the golf swing.

In some embodiments of the golf swing training device, the lock bar automatically slides into the unlocked position near the end of the down-swing portion of a golf swing.

In some embodiments, the golf swing training device further comprises a first magnetic force generating device disposed in the first brace member for retaining the lock bar in the locked position.

In some embodiments of the golf swing training device, the first magnetic force generating device releases the lock bar and allows the lock bar to slidably move into the unlocked position due to a centrifugal force generated on the lock bar during the down-swing portion of the golf swing.

In some embodiments, the golf swing training device further comprises a second magnetic force generating device disposed in the second brace member for attracting and retaining the lock bar in the second position.

In some embodiments of the golf swing training device, the lock bar includes an adjustment member for adjusting a magnetic attractability of the lock bar to the first magnetic force generating device.

In some embodiments, the golf swing training device further comprises a gravity activated pendulum pivotally mounted within the first brace member, the pendulum being rotatable between first and second positions, the pendulum in the first position engaging and retaining the lock bar in the locked position, the pendulum in the second position being disengaged from the lock bar.

In some embodiments of the golf swing training device, the pendulum automatically rotates via gravity from the first position to the second position to release the lock bar so the lock bar can freely slide into the unlocked position.

In some embodiments, the golf swing training device further comprises a ball rollingly disposed within an elongated channel formed in the pendulum.

In some embodiments of the golf swing training device, the pendulum comprises a body and a hook structure, the body having the elongated channel containing the ball and the hook structure for engaging the lock bar and retaining the lock bar in the locked position.

In some embodiments of the golf swing training device, the body having a pivot end and a free end disposed opposite the pivot end, the channel having a first end marginally adjacent the pivot end of the body and a second end marginally adjacent the free end of the body, wherein the ball at the first end of the channel aids in holding the pendulum in the first position to retain the lock bar in the locked position and wherein the ball aids the pendulum in rotating from the first position to the second position as the ball rolls within the channel from the first end thereof to the second end thereof during rotation of the pendulum.

In some embodiments, the golf swing training device further comprising a magnetic force generating device disposed within the body of the pendulum at a location marginally adjacent to the free end of the body, the magnetic force generating device being operative for holding the pendulum in the second position until the pendulum is manually rotated back to the first position.

In some embodiments, the golf swing training device further comprising a lever for allowing a user to manually rotate the pendulum back to the first position.

In some embodiments, the golf swing training device further comprising a finger gripping element for allowing a user to manually slide the lock bar back toward the first brace member so that it can be retained in the locked position by the pendulum.

In some embodiments, the golf swing training device further comprising a finger gripping element for allowing a user to manually slide the lock bar back toward the first brace member so that it can be retained in the locked position.

In some embodiments of the golf swing training device, the lock bar includes a slot for receiving a hook structure of the pendulum when the pendulum is in the first position engaging and retaining the lock bar in the locked position.

In some embodiments, the golf swing training device further comprises a platform, upon which the elbow bracing assembly is mounted, the platform including a tension spring for compensating for a change in a length of the elbow bracing assembly, as the elbow bracing assembly pivots with the bending of the elbow of the leading arm during the up-swing portion of the golf swing.

BRIEF DESCRIPTION OF THE DRAWING

FIGS. 3A-3F collectively illustrate an exemplary embodiment of the elbow bracing assembly of the present disclosure wherein FIG. 3A is an exploded top perspective view, FIG. 3B is a top perspective view, FIG. 3C is a side view, and FIGS. 3D-3F are top views.

FIGS. 5A-5I collectively illustrate another exemplary embodiment of elbow bracing assembly of the present disclosure wherein FIG. 5A is a top perspective view, FIG. 5B is a side view, FIG. 5C is an end view of a first end of a first brace member of the elbow bracing assembly, FIG. 5D is an end view of a second end of the first brace member, FIG. 5E is an end view of a second end of a second brace member of the elbow bracing assembly, FIG. 5F is an end view of a second end of the second brace member, and FIGS. 5G-5I are sectional side views of the elbow bracing assembly.

FIGS. 6A-6C collectively illustrate an exemplary embodiment of a rigid lock bar of a lock assembly of the elbow bracing assembly of FIGS. 5A-5I wherein FIG. 6A is a perspective view, FIG. 6B is a top view, and FIG. 6C is a side view.

FIGS. 7A-7H collectively illustrate an exemplary embodiment of a gravity activated locking pendulum of the lock assembly of the elbow bracing assembly of FIGS. 5A-5I wherein FIG. 7A is a top perspective view from a body end of the pendulum, FIG. 7B is a top perspective view from a hook end of the pendulum, FIG. 7C is a top view, FIG. 7D is a bottom view, FIGS. 7E and 7F are perspective views illustrating to and bottom longitudinal sections of the elongated body of the pendulum, FIG. 7G is a perspective view adjacent a pivot end of the elongated body showing the body in section and FIG. 7H is a perspective view adjacent a free end of the elongated body showing the body in section.

DETAILED DESCRIPTION

FIGS. 1A-1D illustrate exemplary embodiments of a golf swing training device 20 according to the present disclosure. The golf swing training device 20 generally includes a flexible arm attachment member 30 and an elbow bracing assembly 40 (FIGS. 1A and 1B), 140 (FIGS. 1C and 1D) made of a lightweight metal alloy, which is attached to or integrated with the arm attachment member 30, for locking and unlocking the device 20.

As illustrated in FIGS. 10A-10D, the golf swing training device 20 is worn by a golfer about the elbow of the leading arm 12 (the left arm in the case of right-handed golfers, and the right arm in the case of left-handed golfers).

Figure 1B:
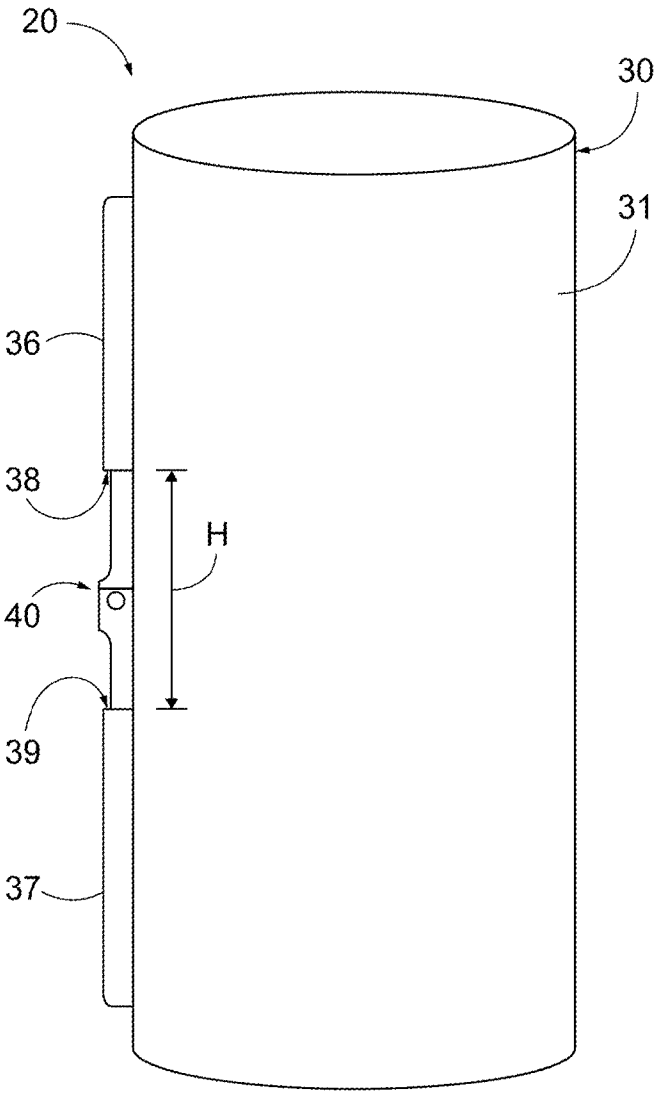
FIGS. 1A and 1B are front and side views collectively illustrating an exemplary embodiment of a golf swing training device of the present disclosure.
Figure 1A:
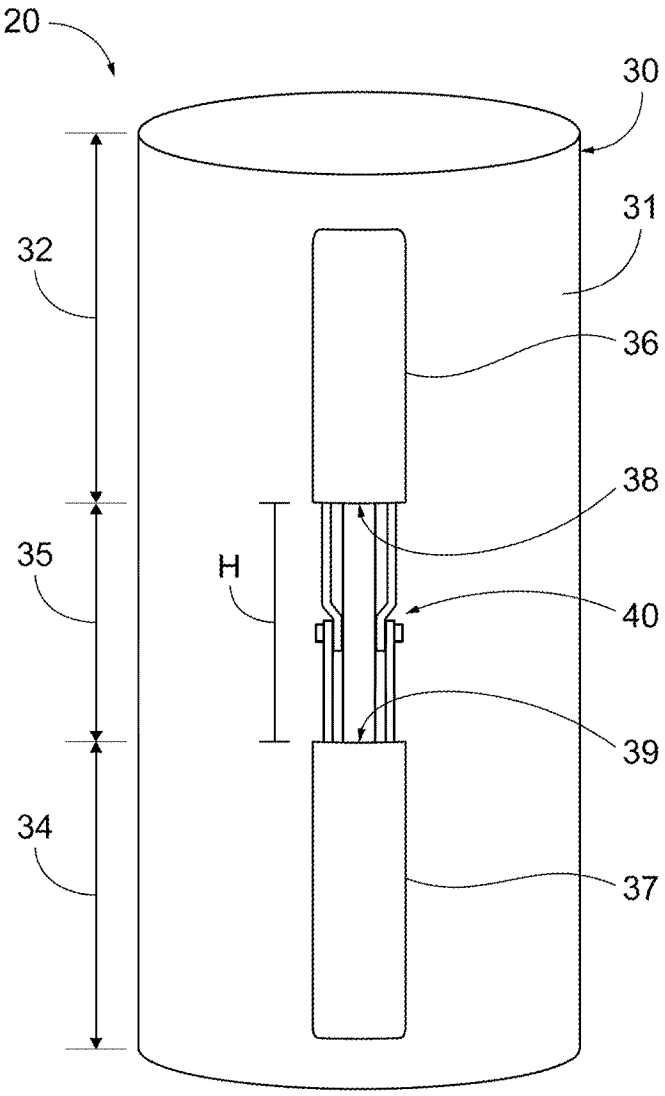
Figure 1D:
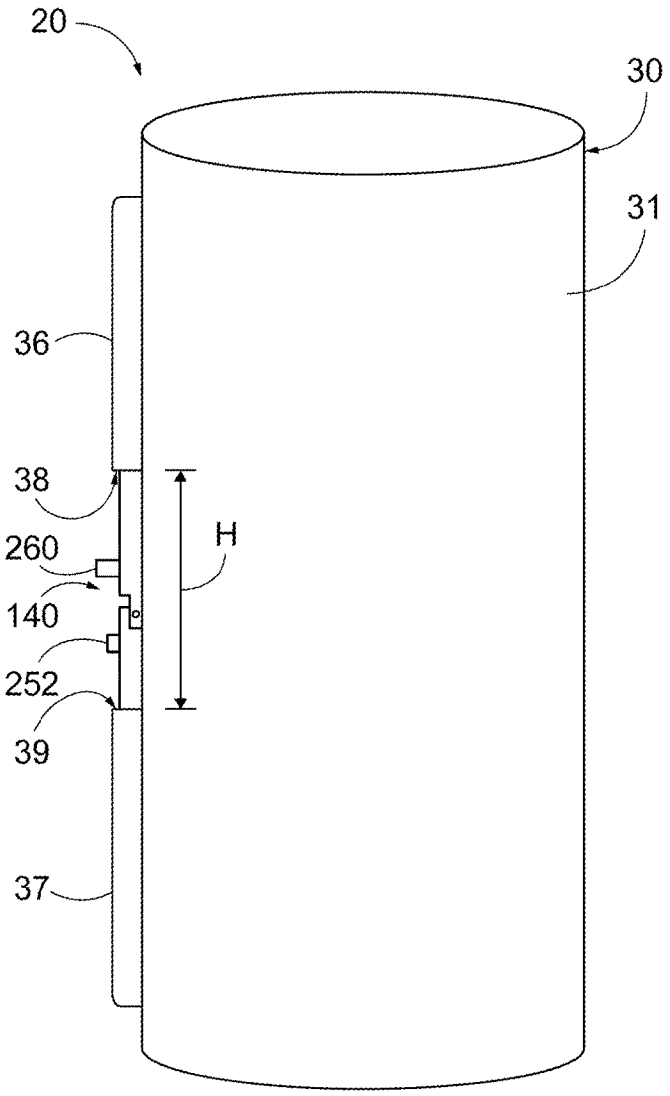
FIGS. 1C and 1D are front and side views that collectively illustrating another exemplary embodiment of a golf swing training device according to the present disclosure.
Figure 1C:
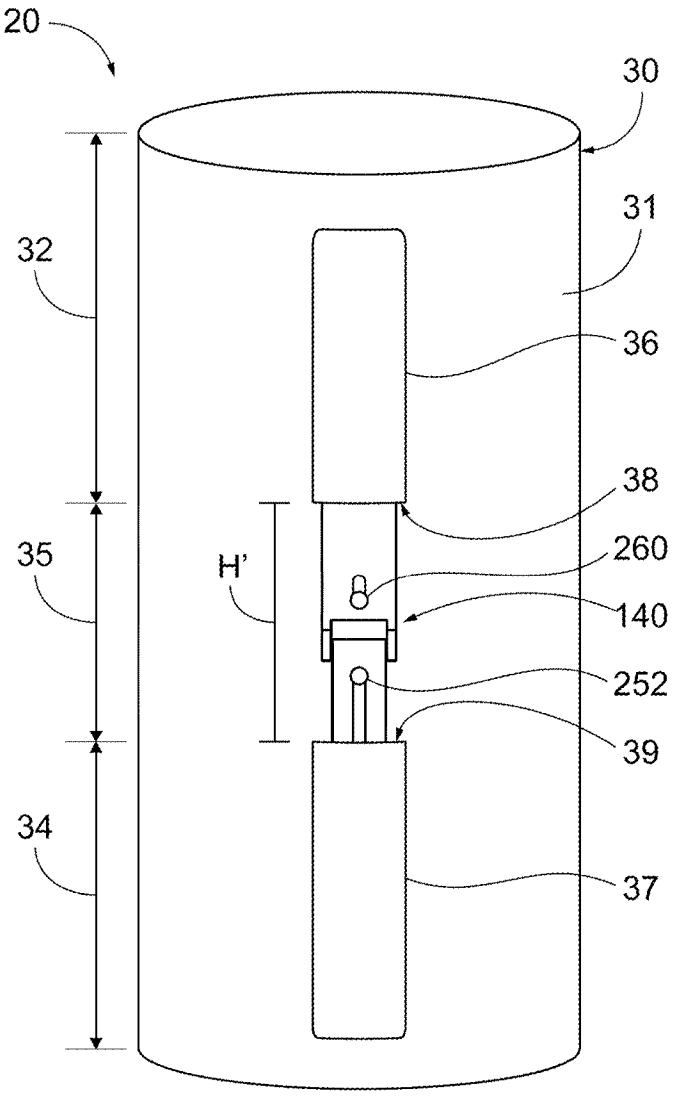
Figure 2:
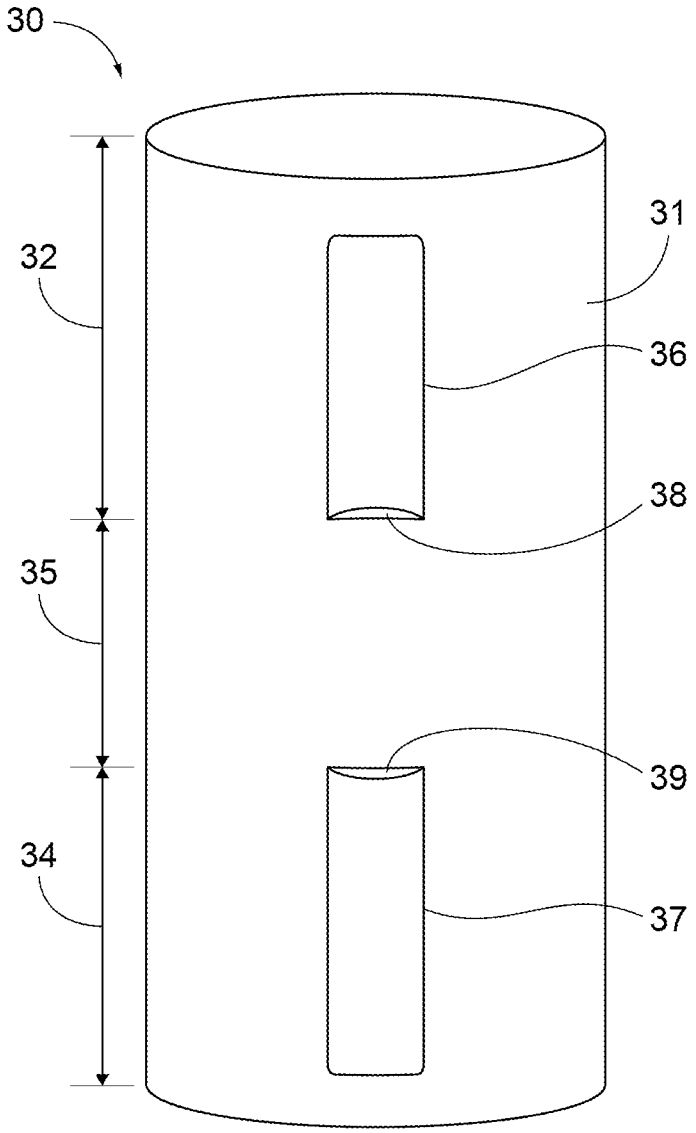
FIG. 2 is a front view illustrating an exemplary embodiment of the attachment member of the present disclosure.

FIG. 2 illustrates an exemplary embodiment of the attachment member 30. As illustrated, the attachment member 30 comprises a flexible tubular sleeve 31 having an upper portion 32 and a lower portion 34. The sleeve 31 can be made of a fabric-like material, such as nylon, elastic, or neoprene. The material should have a degree of elasticity that allows the attachment member 30 of the device 20 to be slid onto the leading arm 12 of the golfer to the elbow region and then retain the attachment member 30 at the desired position without slipping or falling off. The outer surface of the sleeve 31 can include an inline arranged pair of pockets 36 and 37 disposed on the upper and lower portions 32 and 34 of the sleeve 31, for attaching respective first and second elongated brace members 42, 142 and 44, 144 of the elbow bracing assembly 40, 140 to the sleeve 31, as illustrated in FIGS. 1A and 1B (elbow bracing assembly 40) and as illustrated in FIGS. 1C and 1D (elbow bracing assembly 140). The upper and lower pockets 36 and 37 are spaced apart from one another and have opposed openings 38 and 39 for allowing the first and second brace members 42, 142 and 44, 144 of the elbow bracing assembly 40, 140 to be inserted in their respective pockets 36 and 37, such that the first brace member 42, 142 is partially disposed in the first pocket 36 of the sleeve 31 and the second brace member 44, 142 is partially disposed in the second pocket 37 of the sleeve 31. Other methods can be used to attach the elbow bracing assembly 40, 140 to the sleeve 31 of the attachment member 30 or integrate the elbow bracing assembly 40, 140 with the sleeve 31 of the attachment member 30.

In other embodiments, the arm attachment member can comprise an elongated panel of flexible material that is wrapped around the elbow area of the golfer's leading arm. A hook and loop fastener, zipper, snaps, and/or straps or other arrangements can be used to secure the panel around the elbow area of the arm. The panel of flexible material can include pockets similar to those described above or other means for attaching the elbow bracing assembly to the panel of flexible material.

In still other embodiments, the arm attachment member can comprise two or more straps of flexible material that are wrapped around the upper arm and forearm at the elbow area of the golfer's leading arm. A hook and loop fastener, snaps, and/or other arrangements can be used to secure the straps around the upper arm and forearm of the golfer's leading arm. The straps can include pockets similar to those described above for or other means for attaching the elbow bracing assembly to the straps.

FIGS. 3A-3F collectively illustrate an exemplary embodiment of the elbow bracing assembly 40. As illustrated, the elbow bracing assembly 40 comprises the earlier described first and second brace members 42 and 44, a hinge 46 pivotally connecting the first brace member 42 with the second brace member 44, a sliding lock bar 80, and an optional magnetic force generating device 90.

The elongated first and second brace members 42 and 44 each includes a free end 50, 60, a hinge end 52, 62, an elongated base wall 54, 64, and opposing elongated longitudinal side walls 56, 66 connected by the base wall 54, 64. The base walls 54, 64 and the side walls 56, 66 of each brace member 42, 44 define a generally U-shape open channel 70 having a bottom surface 72 formed by the base wall 54 of the first brace member 42 and the base wall 64 of the second brace member 44. The side walls 56 of the first brace member 42 at the hinge end 52 thereof, extend beyond the base wall 54, taper in towards each other (the base wall 54 narrows in width in this area too), and are taller so as to form a pair of hinge walls 58 of the hinge 46. The side walls 66 of the second brace member 44 at the hinge end 62 thereof, extend beyond the base wall 64 and are taller in height so as to form a pair of hinge arms 68 of the hinge 46. The pair of hinge walls 58 of the first brace member 42 fit between and are overlapped by the pair of hinge arms 68 of the second brace member 44 (FIGS. 3C-3F). The hinge 46 also includes a pivot pin 47 that extends through aligned openings (not visible) formed in the hinge walls 58 and hinge arms 68 of their respective first and second brace members 42 and 44, to pivotally connect the first and second brace members 42 and 44 with each other.

It should be understood that in other exemplary embodiments, the first and second brace members 42 and 44 can each be configured as an elongated tube having, for example, a rectangular, square, triangular, circular, or oval transverse cross-section.

Referring still to FIGS. 3A-3F, the lock bar 80 can comprise an elongated member having, for example, a rectangular, square, circular, or oval transverse cross-section. The lock bar 80 is slidably disposed in the channel 70. The taller overlapping sidewall portions 58 and 60 allow the location of the pivot pin 47, which extends transversely across the channel 70, to be raised within the channel 70 so that the lock bar 80 can freely slide under the pivot pin 47 as it slidably moves in the channel 70 to selectively control relative pivotal movement between the first and second brace members 42 and 44 during the golf swing. If provided, the magnetic force generating device 90 is fixedly disposed on the base wall 54 of the first brace member 42. In such embodiments, the lock bar 80 should be made of a magnetically attractable material, such as steel, so that the lock bar 80 is capable of being magnetically attracted to the magnetic force generating device 90. Magnetic versions of the lock bar 80 can include an optional adjustment member 84, such as a non-magnetic screw, at a first end 82 thereof for adjusting the magnetic attractability of the lock bar 80 to the magnetic force generating device 90.

The magnetic force generating device 90, in some embodiments, can comprise a permanent magnet. In other embodiments, the magnetic force generating device 90 can comprise an electric circuit which selectively generates a magnetic field during the golf swing. The electric circuit can include an accelerometer for selectively closing and opening the electric circuit. When accelerometer senses no centrifugal force the electric circuit is closed and generates a magnetic field. When accelerometer senses a centrifugal force during the down-spring portion of the golf swing, the accelerometer changes its polarity and opens the circuit thereby terminating the magnetic field.

As illustrated in FIGS. 1A and 1B, a hinge area H of the elbow bracing assembly 40 remains accessible to the golfer due to the first and second brace members 42 and 44 being only partially disposed in the first and second pockets 36 and 37 of the sleeve 31. Therefore, the golfer can access the lock bar 80 and manually slide the lock bar 80 into a first position to place the elbow bracing assembly 40 in a locked mode prior to swinging the golf club, as will be explained further on.

Figure 3A:
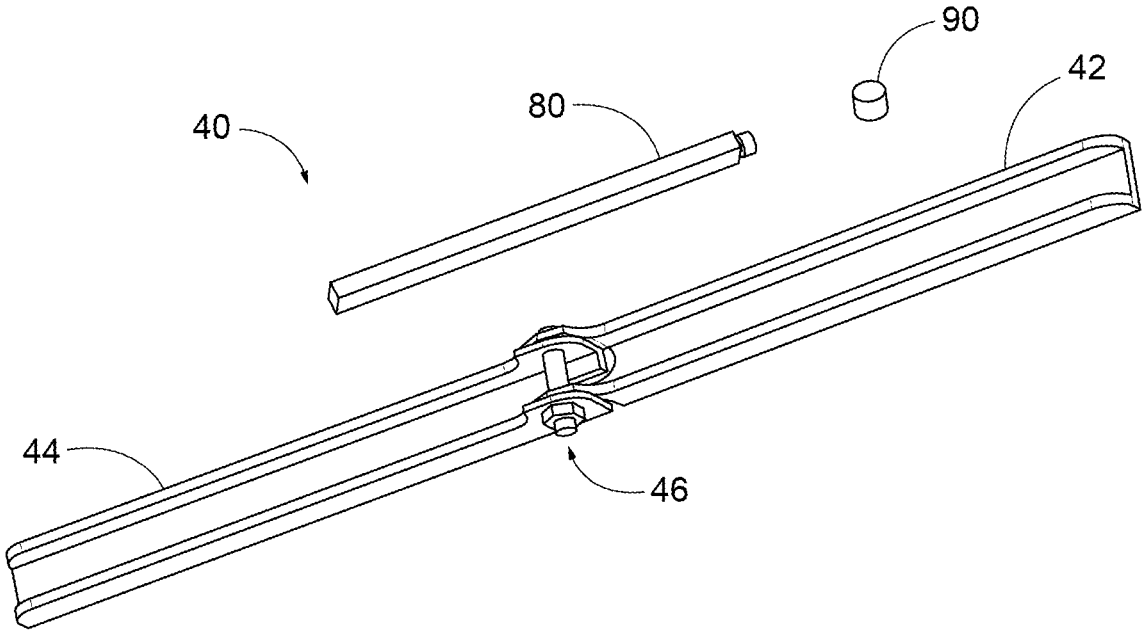
Figure 3B:
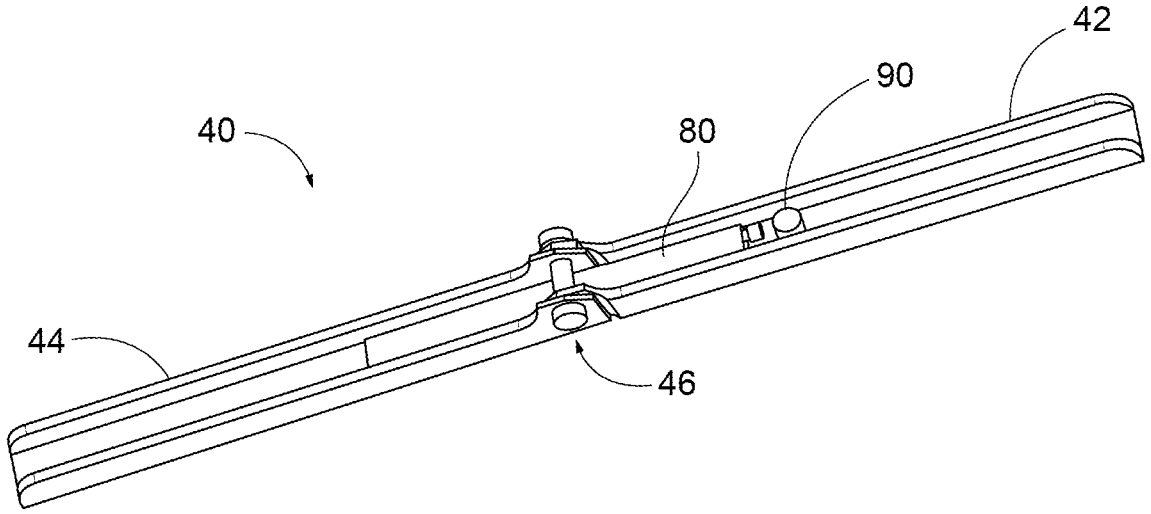
Figure 3C:
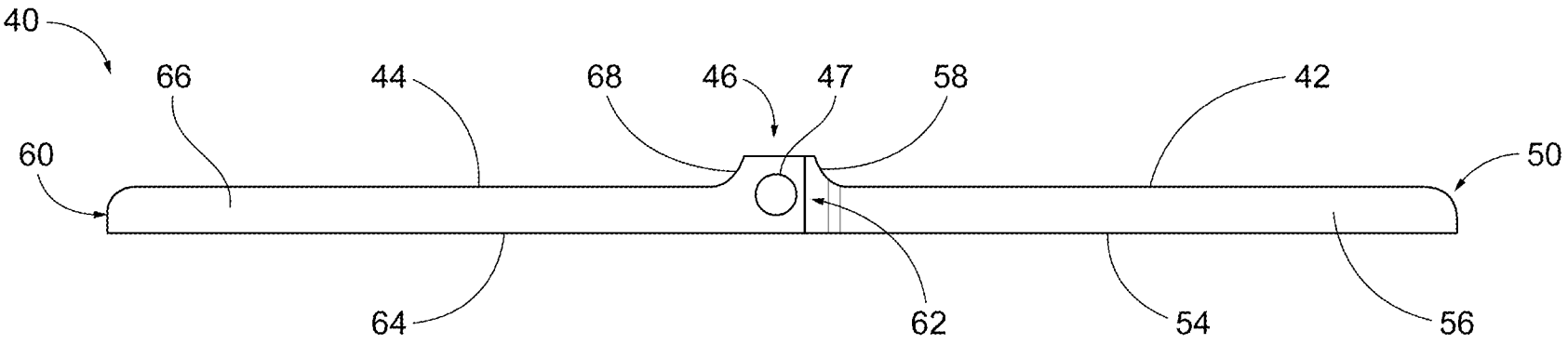
Figure 3D:
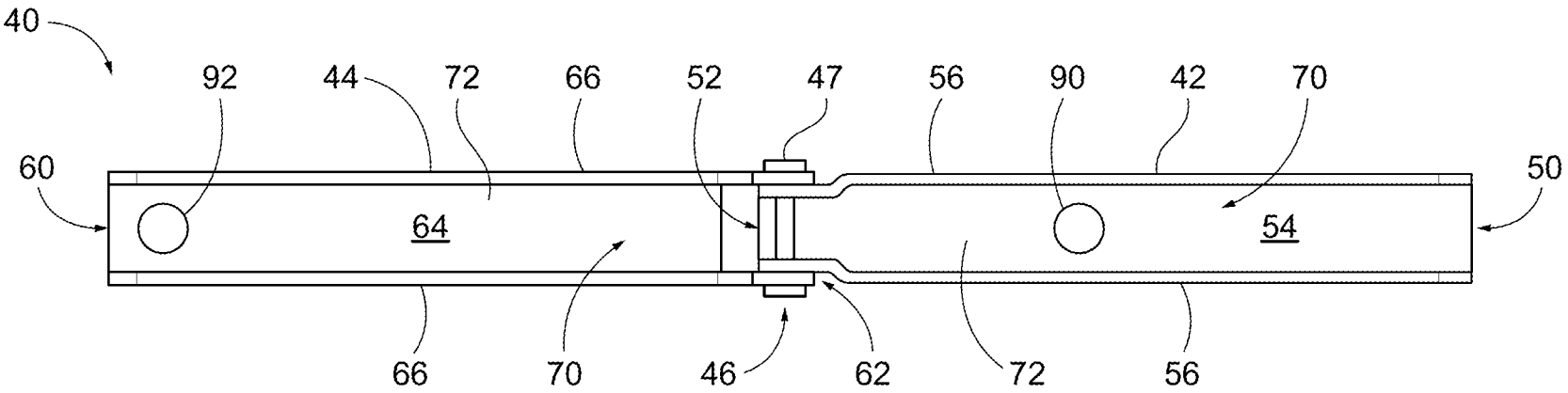
Figure 3E:
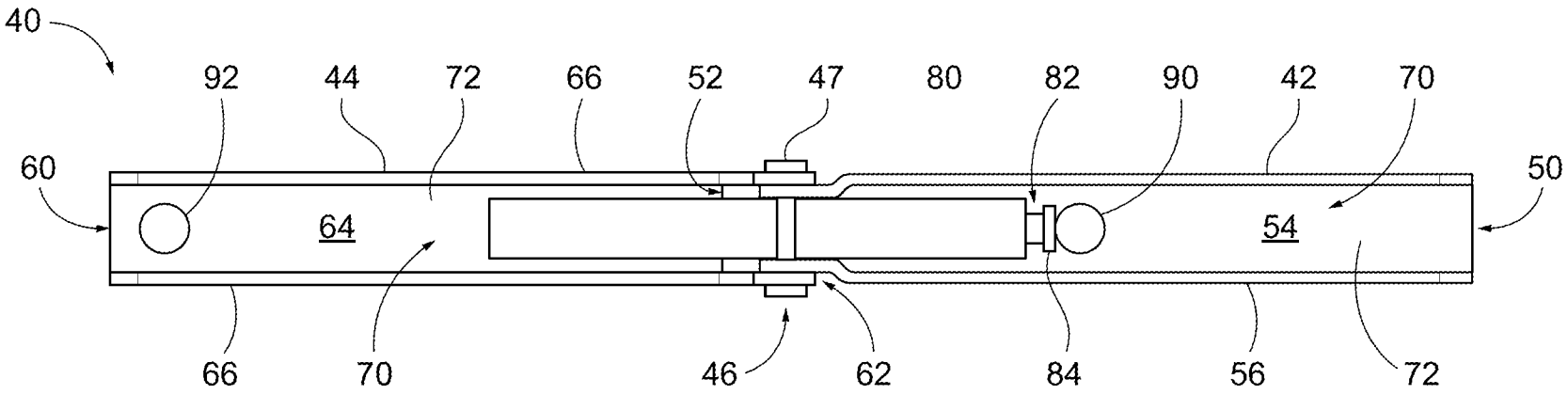

FIG. 3E, illustrates the elbow bracing assembly 40 of the golf swing training device 20 in a locked mode. As illustrated, the adjustment member 84 of the lock bar 80 contacts the magnetic force generating device 90 in a first position within the channel 70 in the locked mode. The magnetic force generating device 90 magnetically attracts and thereby holds the lock bar 80 in the first position within the channel 70 so that the lock bar 80 extends across the pivot hinge 46/hinge area H and extends into in the first and second brace members 42, 44. In the first or locked position, the lock bar 80 substantially prevents or fully prevents pivotal movement between the first and second brace members 42, 44 (i.e., substantially prevents or fully prevents the second brace member 44 from pivoting at the pivot hinge 46 toward the first brace member 42 in use). Accordingly, in the locked mode, the sleeve 31 is held straight in an un-bent position by the elbow bracing assembly 40, which in turn, maintains the elbow of the golfer's leading arm in the un-bent straight position.

Since golfers usually attempt to bend the leading arm during the back-swing portion of the golf swing, the golfer can hold the lock bar 80 in the first position within the channel 70, thereby eliminating the need for the magnetic force generating member 90, as illustrated in FIG. 3G. Specifically, as the golfer attempts to bend the leading arm during the back-swing portion of the golf swing, the first and second brace members 42, 44 can pivot very slightly with respect to one another (7 to 15 degrees) due to slight clearance provided between the lock bar 80 and the portion 94 pivot pin 47 extending across the channel 70 so that the lock bar 80 can freely slide within the channel 70. This slight pivoting of the first and second brace members 42, 44 clamps the lock bar 80 between the pin portion 94 and the base walls 54, 64 of the brace members 42, 44 when the lock bar 80 is in the first or locked position. Therefore, it is contemplated that in some embodiments, the optional magnetic force generating device 90 can be omitted.

Figure 3F:
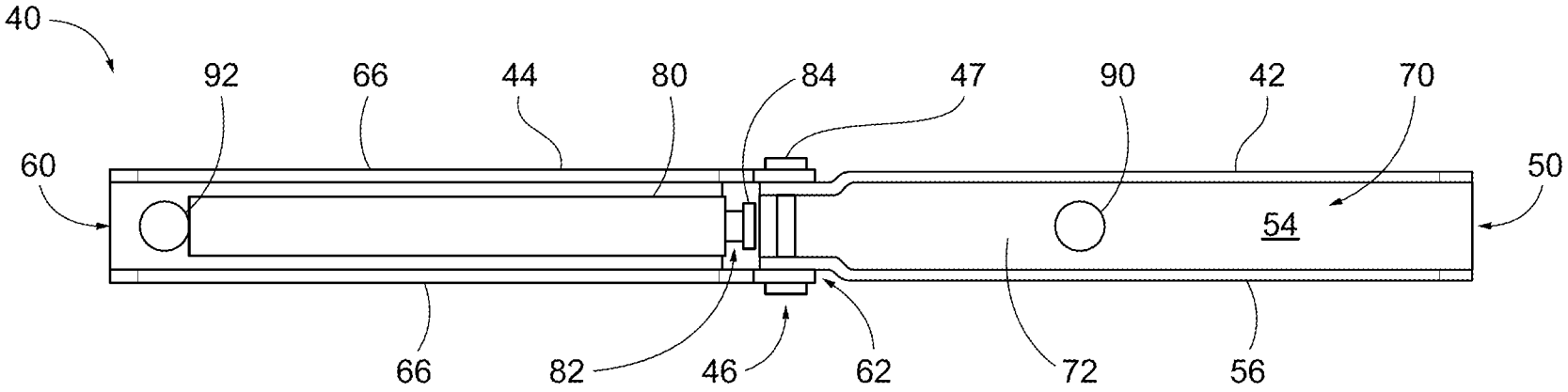

FIG. 3F illustrates the elbow bracing assembly 40 of the golf swing training device 20 in an unlocked mode. As illustrated, the lock bar 80 is substantially or completely disposed within the portion of the channel 70 defined by the second brace member 44 in a second or unlocked position, so that the first and second brace members 42, 44 can pivot relative to one another. With the elbow bracing assembly 40 in the unlocked mode, the sleeve 31 can be easily bent by the leading arm of the golfer during the final upswing portion of the golf swing. In some embodiments, a second magnetic force generating device 92 (e.g. permanent magnet) can be fixedly disposed on base wall 64 of the second brace member 44, to aid in withdrawing the lock bar 80 out of the first brace member 42 during the automatic unlocking process described further on. As illustrated in FIG. 3F, the second magnetic force generating device 92 also operates as a stop for the lock bar 80.

The elbow bracing assembly 40 of the golf swing training device is configured to automatically switch from the locked mode illustrated in FIG. 3E to the unlocked mode illustrated FIG. 3F at or near the bottom or end of down-swing portion of the golf swing. More specifically, centrifugal force is generated on the lock bar 80 during the down-swing portion of the golf swing. The centrifugal force reaches a level at or near the end of the down-swing portion of the golf swing that overcomes the magnetic force generated by the magnetic force generating device 90 when it comprises the magnet or if the magnetic force generating device 90 is the electric circuit, changes the polarity of the accelerometer of the electric circuit and terminate the magnetic field generated thereby, which holds the lock bar 80 in the first position within the channel 70. In addition, the leading arm of the golfer tends to naturally straighten at the end of the down-swing, thereby releasing any clamping force generated against the lock bar 80 by the pivot pin 47 and the brace members 42, 44. The centrifugal force acting on the lock bar 80 causes it to slidably move within the channel 70 toward the second brace member 44. The lock bar 80 continues to slidably move within the channel 70 toward second brace member 44 under the centrifugal force until it is substantially or completely out of the first brace member 42 and substantially or completely within the second brace member 44 in the second position, thereby unlocking the elbow bracing assembly 40 of the golf swing training device 20 just before or at the end of the down-swing portion of the golf swing.

Figure 4:
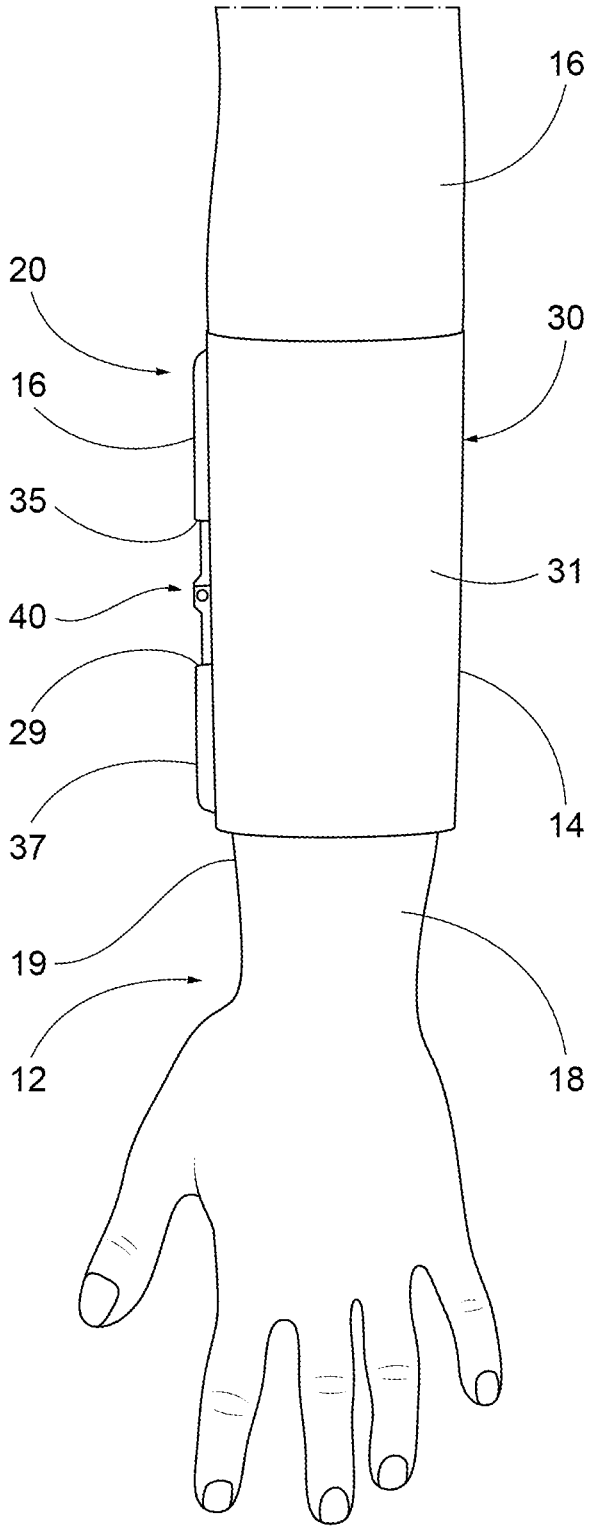
FIG. 4 illustrates a golfer wearing the elbow bracing assembly of FIGS. 3A-3F.

In use, as illustrated in FIG. 4, the golfer places the device 20 on the leading arm 12 by inserting the leading arm 12 into the lower portion 34 of the sleeve 31 of the device 20. The device 20 is then slidably positioned at the elbow of the leading arm 12 of the golfer so that a generally central section 35 of the sleeve 31 surrounds the elbow 14 of the leading arm 12, the upper portion 32 of the sleeve 31 surrounds the upper arm/bicep 16 of the golfer, the lower portion 36 of the sleeve 31 surrounds the forearm 18 of the golfer, and the elbow bracing assembly 40 extends longitudinally across the antecubital space or "elbow pit" of the arm 12 with the first brace member 42 extending generally over a portion the bicep of the upper arm 16 and the second brace member 44 extending generally over an inner portion of the forearm 18.

Figure 10A:
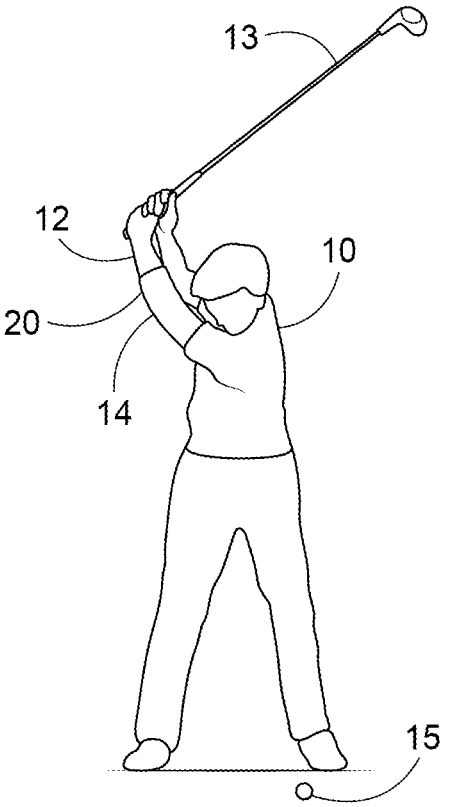
FIGS. 10A-10D collectively illustrate a golfer using the golf swing training device of the present disclosure to properly swing a golf club.
Figure 10B:
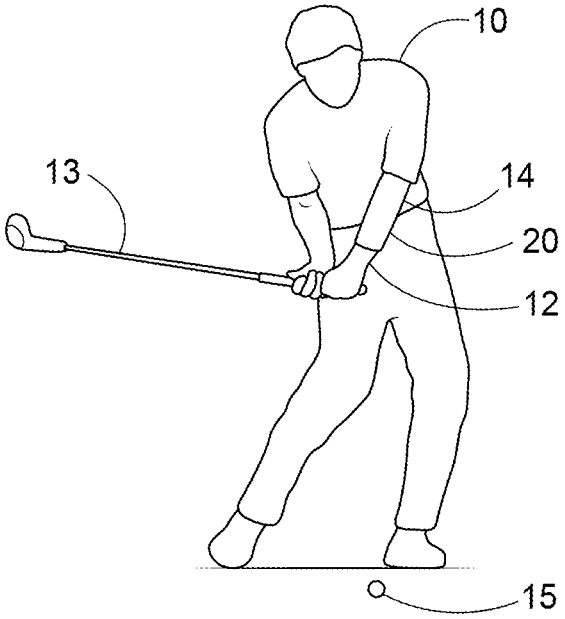
Figure 10C:
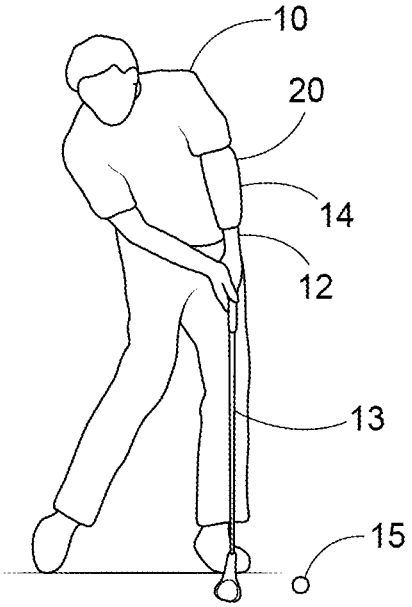
Figure 10D:
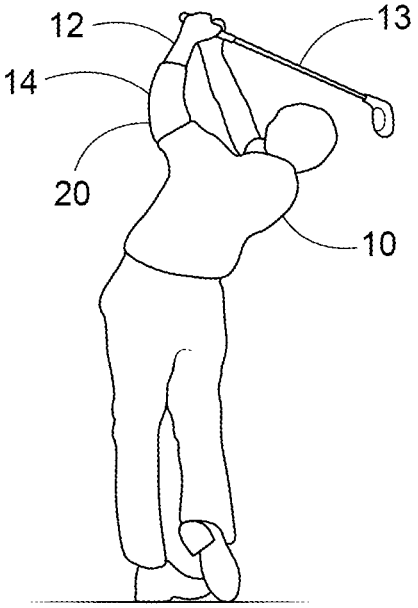

FIGS. 10A-10D collectively illustrate a golfer 10 using the golf swing training device 20 of the present disclosure to properly swing a golf club 13, such as a wood (shown) or a long iron. Prior to swinging the golf club, the golfer places his/her arm in the unbent position and manually slides the lock bar 80 of the elbow bracing assembly 40 toward the first brace member 42 to set the device 20 into the locked mode (FIG. 3E). With the elbow bracing assembly 40 of the device 20 in the locked mode, the device 20 maintains the elbow 14 of the golfer's leading arm 12 in the un-bent straight position as the golfer 10 raises the golf club 13 during the back-swing portion of the golf swing, as illustrated in FIG. 10A. The elbow bracing assembly 40 of the device 20 in the locked mode, maintains the elbow 14 of the golfer's leading arm 12 in the un-bent straight position, as the golfer 10 lowers the golf club 13 during the down-swing portion of the golf swing, as illustrated in FIG. 10B, and remains in the locked mode to maintain the elbow 14 of the golfer's leading arm 12 in the un-bent straight position, as the golfer 10 contacts the golf ball 15 with the head of the golf club 13, as shown in FIG. 10C. Just after contact with the golf ball 15 has been made with the head of the golf club 13, the lock bar 80 of the elbow bracing assembly 40 automatically releases and enters the unlocked mode where it slides completely into the second brace member 44 (FIG. 3F), which thereby allows the first and second brace members 42 and 44 to pivot at hinge 46 as the elbow 14 of the golfer's leading arm 12 bends so that the golfer 10 can perform the up-swing portion of the golf swing, as illustrated in FIG. 10D.

Figure 5A:
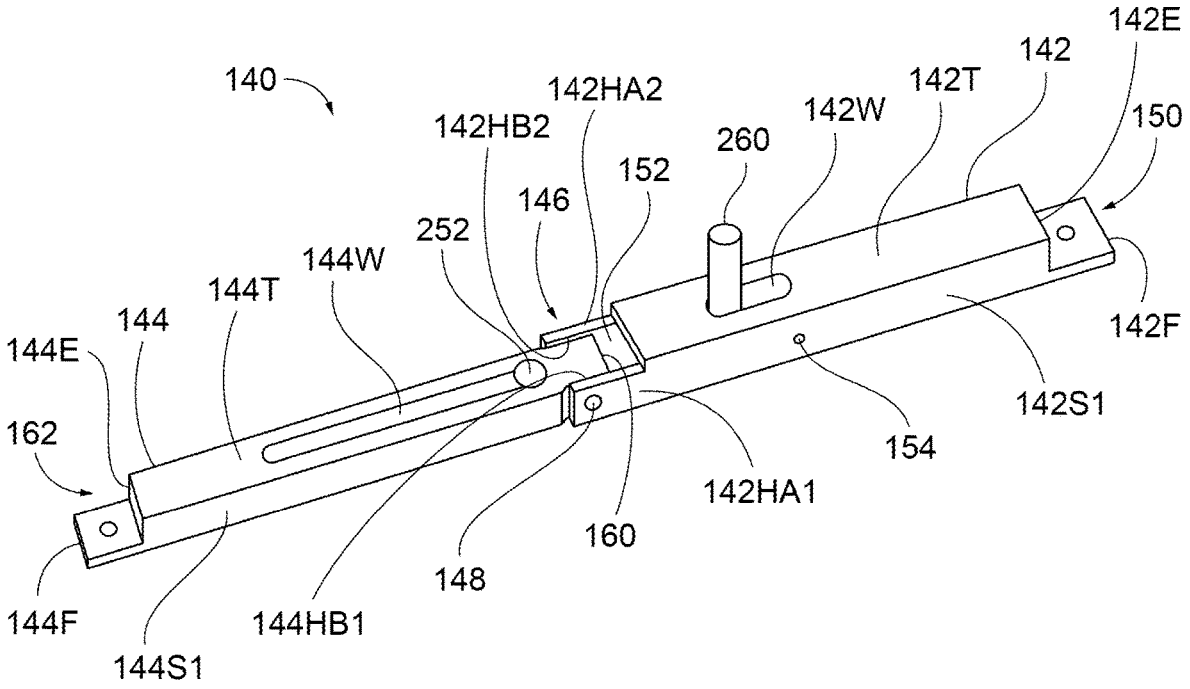
Figure 5B:
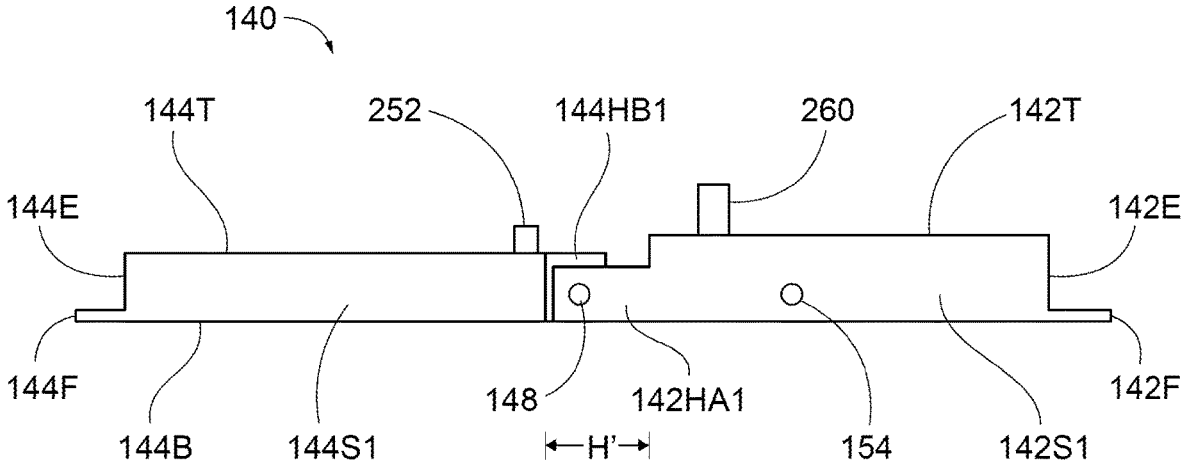
Figure 5C:
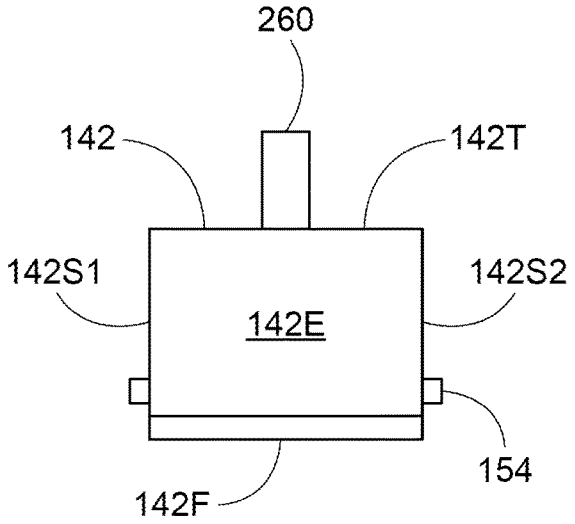
Figure 5D:
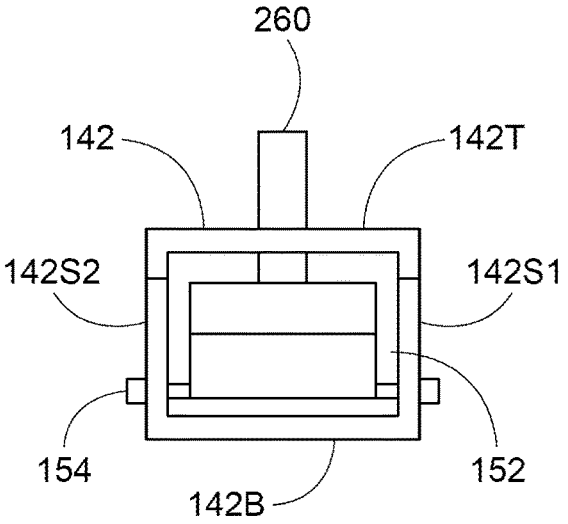
Figure 5E:
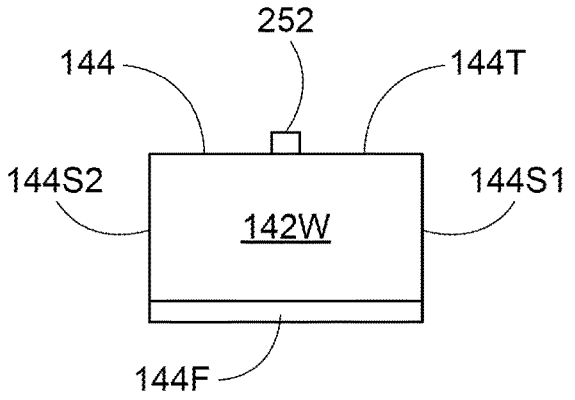
Figure 5F:
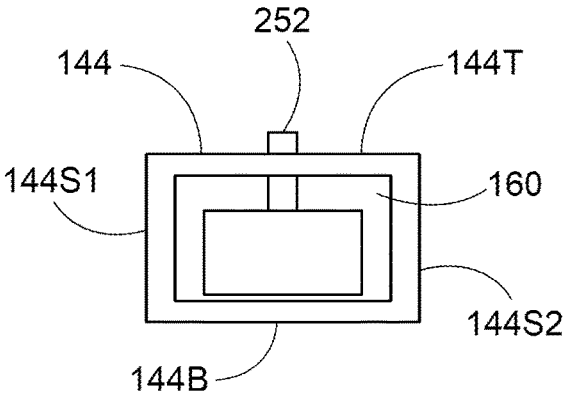
Figure 5G:
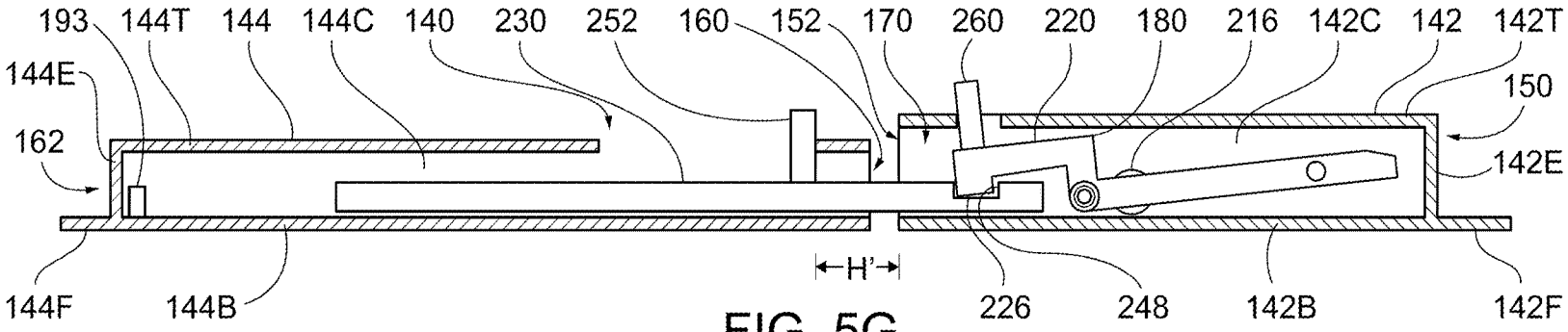
Figure 5H:
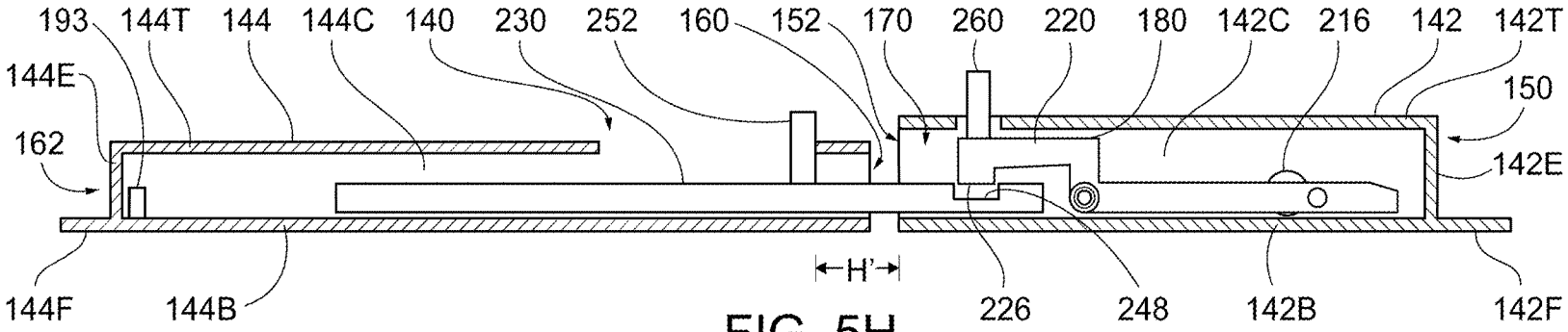
Figure 5I:
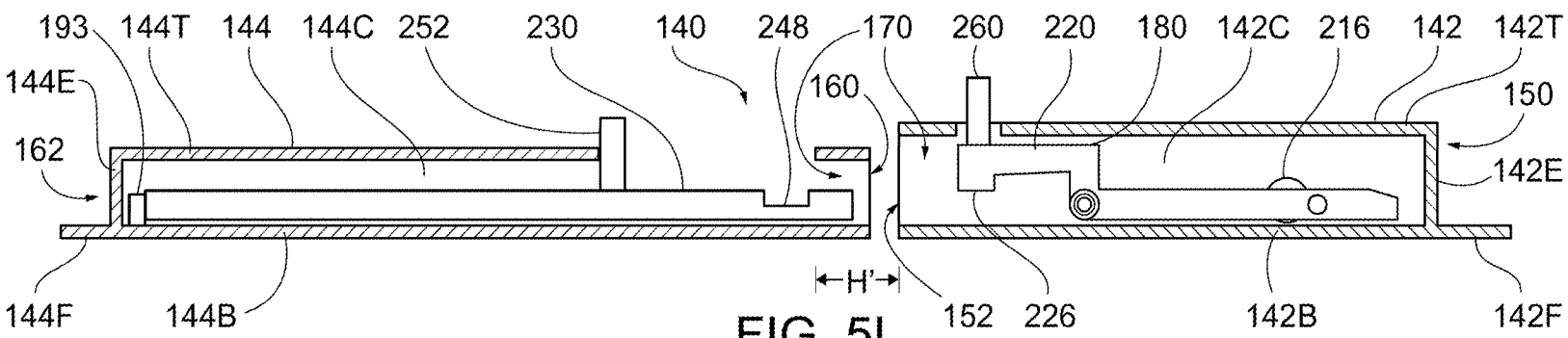
Figure 8A:
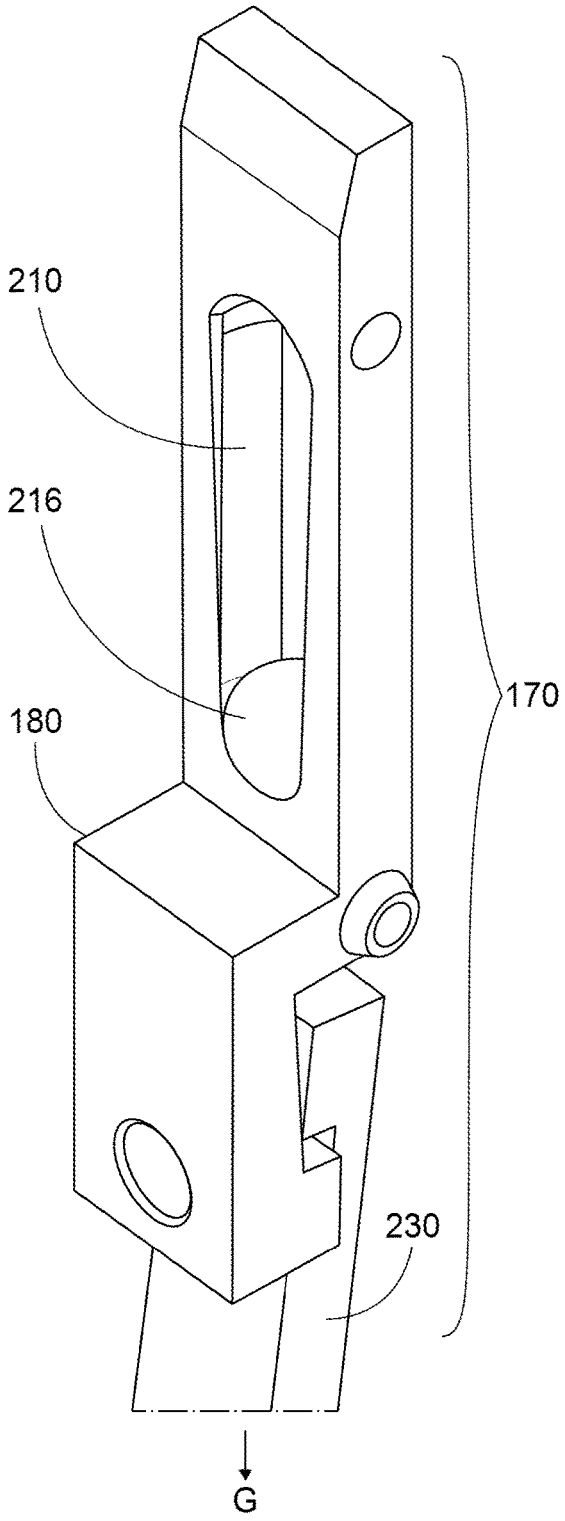
FIGS. 8A and 8B are top perspective views collectively illustrating the operation of the lock assembly of the elbow bracing assembly of FIGS. 5A-5I.
Figure 8B:
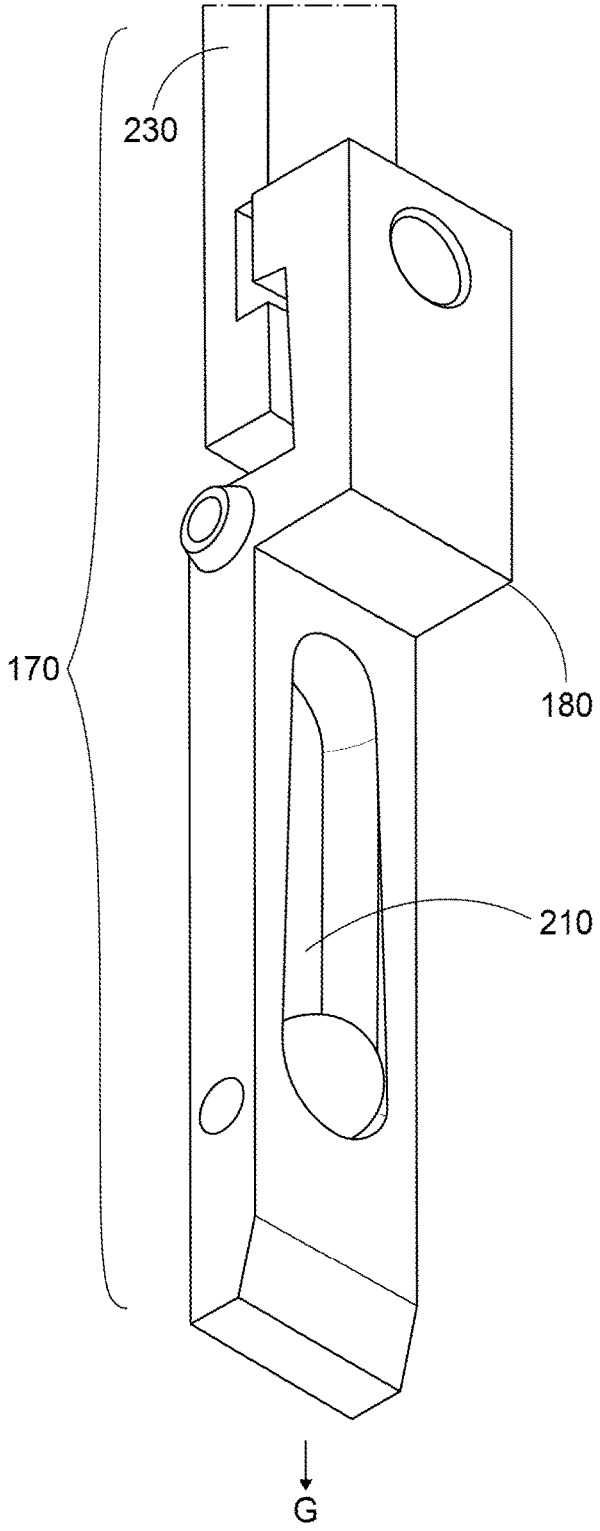

FIGS. 5A-5I collectively illustrate another exemplary embodiment of elbow bracing assembly denoted by reference character 140. As illustrated, the elbow bracing assembly 140 comprises first and second brace members 142 and 144, a hinge 146 pivotally connecting the first brace member 142 with the second brace member 144, a lock assembly 170 disposed within the first and second brace members 142 and 144. As illustrated in FIGS. 5G-5I, the lock assembly 170 comprises a gravity activated locking pendulum 180 pivotally mounted within the first brace member 142, a rigid sliding lock bar 230, and a spherical-shaped member or ball 216 moveably disposed in an elongated channel 210 of the pendulum 180 (FIGS. 8A and 8B). The sliding lock bar 230 is secured in the lock position by the locking pendulum 180 which is configured to hold the lock bar 230 across a hinge area H' (FIGS. 5B and 5G-5I) of the bracing assembly 140 throughout the golfer's backswing and continuing through the downswing, and then releasing as the golfer starts the "follow through" or up-swing portion of the golf swing. A magnet 193 can be provided in the second brace member 144 adjacent to an end wall $\mathbf{144}_E$ thereof for attracting the released sliding lock bar 230.

Referring still to FIGS. 5A-5I, the first and second brace members 142 and 144 are each configured as an elongated tube having, for example, a rectangular, square, circular, or oval transverse cross-section. As in the previous embodiment of the elbow bracing assembly, the first brace member 142 will be partially disposed in the first pocket 36 of the sleeve 31 illustrated in FIGS. 1A and 1B, and the second brace member 144 will partially disposed in the second pocket 37 of the sleeve 31 illustrated in FIGS. 1A and 1B, so that a finger gripping element 252 of the lock bar 230 and a lever 260 of the pendulum 180 can be accessed by the golfer. In the embodiment illustrated in FIGS. 5A-5I, the first brace member 142 has a first end 150 closed by an end wall $\mathbf{142}_E$, opposing top and bottom walls $\mathbf{142}_T$ and $\mathbf{142}_B$, opposing first and second side walls $\mathbf{142}_{S1}$ and $\mathbf{142}_{S2}$, and an open second end 152. A mounting flange 142 extends longitudinally away from the bottom of the end wall $\mathbf{142}_E$ at the first end 150 of the first brace member 142. First and second hinge arms $\mathbf{142}_{HA1}$ and $\mathbf{142}_{HA2}$ of the hinge 146 extend longitudinally from the first and second sidewalls $\mathbf{142}_{S1}$ and $\mathbf{142}_{S2}$, respectively, at the open second end 152 of the first brace member 142. The second brace member 144 has an open first end 160, opposing top and bottom walls $\mathbf{144}_T$ and $\mathbf{144}_B$, opposing first and second side walls $\mathbf{144}_{S1}$ and $\mathbf{144}_{S2}$, and a second end closed 162 by the earlier mentioned end wall $\mathbf{144}_E$. A mounting flange $\mathbf{144}_F$ extends longitudinally away from the bottom of the end wall $\mathbf{144}_E$ at the second end 162 of the second brace member 144. The first and second sidewalls $\mathbf{144}_{S1}$ and $\mathbf{144}_{S2}$ taper inwardly at the first end 160 of the second brace member 144 and thereby form a pair of hinge walls $\mathbf{144}_{HB1}$ and $\mathbf{144}_{HB2}$ of the hinge 146 that fit between and are overlapped by the first and second hinge arms $\mathbf{142}_{HA1}$ and $\mathbf{142}_{HA2}$ of the first brace member 142. The hinge 146 also includes pivot pins 148 that extend through aligned openings (not visible) formed in the hinge arms $\mathbf{142}_{HA1}$ and $\mathbf{142}_{HA2}$ and hinge walls $\mathbf{144}_{HB1}$ and $\mathbf{144}_{HB2}$ of their respective first and second brace members 142 and 144, to pivotally connect the first and second brace members 142 and 144 with one another. The top walls $\mathbf{142}_T$, $\mathbf{144}_T$, bottom walls $\mathbf{142}_B$, $\mathbf{144}_B$, and side walls $\mathbf{142}_{S1}$, $\mathbf{142}_{S2}$, $\mathbf{144}_{S1}$, $\mathbf{144}_{S2}$ of each brace member 142, 144 defines an open-ended housing, as illustrated in FIGS. 5G-5I.

Figure 6A:
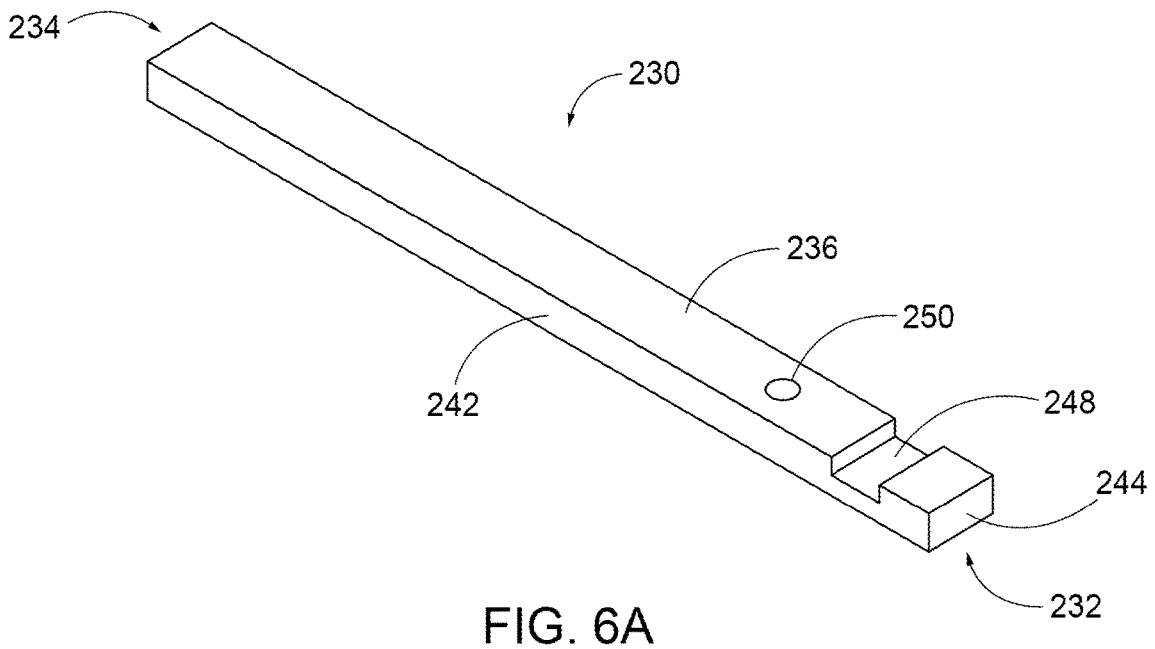
Figure 6B:
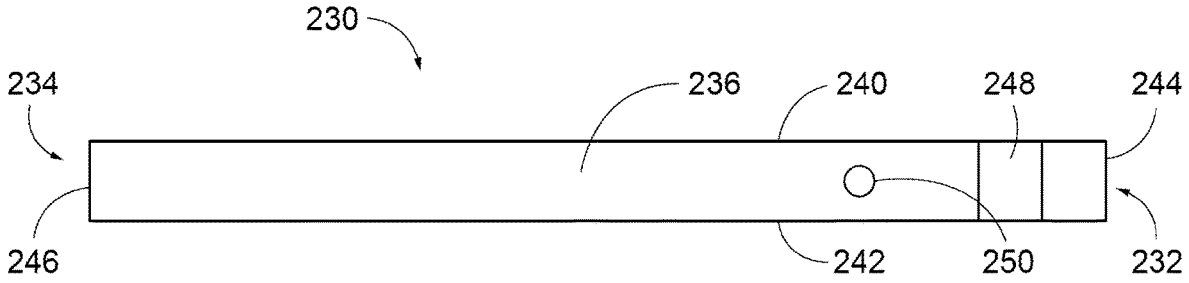
Figure 6C:
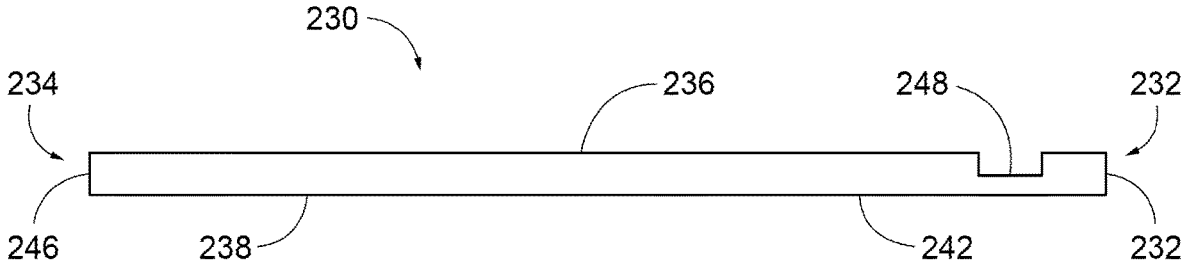

FIGS. 6A-6C collectively illustrate an exemplary embodiment of the rigid lock bar 230 of the lock assembly 170. As illustrated, the lock bar 230 has opposing first and second ends 232 and 234 and includes opposing top and bottom walls 236 and 238, opposing first and second side walls 240 and 242, and opposing end walls 244 and 246. A transverse slot 248 is formed in the top wall 236 of the lock bar 230 marginally adjacent to the first end 232 thereof. An aperture 250 is provided in the top wall 236 of the lock bar 230 for receiving the finger gripping element 252 that extends up from the lock bar 230 and through an elongated window $\mathbf{144}_W$ in the top wall $\mathbf{144}_T$ of the second brace member 144 (FIGS. 5A, 5B, and 5E-5I). The finger gripping element 252 is used by the golfer to slide the lock bar 230 back toward the first brace member 142 so that the first end 232 of the lock bar 230 is positioned inside the first brace member 142 where it can be locked into position across the hinge area H' by the pendulum 180, as illustrated in FIG. 5G, to substantially prevent or fully prevent pivotal movement between the first and second brace members 142 and 144.

FIGS. 7A-7H collectively illustrate an exemplary embodiment of the gravity activated locking pendulum 180 of the lock assembly 170. As illustrated, the pendulum 180 includes an elongated body 182 and a hook structure 220. The elongated body 182 has pivot end 184 and a free end 186, and includes opposing first and second end walls 188 and 190, opposing first and second side walls 192 and 194, and opposing top and bottom walls 196 and 198. A pivot pin aperture 200 is disposed at or adjacent to the pivot end 184 of the body 182. The pivot pin aperture 200 extends transversely through the body 182 from the first side wall 192 to the second side wall 194 thereof. The pivot pin aperture 200 receives a pivot pin 154 (FIGS. 5A-5D) that extends through the side walls $\mathbf{142}_{S1}$, $\mathbf{142}_{S2}$ of the first brace member 142 and the pivot pin aperture 200 of the pendulum 180 to pivotally mount the pendulum 180 within the first brace member 142. Each opening of the pivot pin aperture 200 on each side wall 192, 194 of the body 182 (not visible) is surrounded by annular tapered projection or bushing 202, 204 that abuts against the inner surface of an adjacent one the first brace member side walls $\mathbf{142}_{S1}$, $\mathbf{142}_{S2}$, to allow the pendulum 170 to freely pivot within the first brace member 142. The elongated channel 210 extends through an intermediate section of the body 182 and is open at the top and bottom walls 196, 198 thereof. The channel 210 contains the ball 216 and is configured to allow the ball 216 to roll between a first end $\mathbf{210}_1$ of the channel 210 to a second end $\mathbf{210}_2$ of the channel 210 (FIGS. 8A and 8B). The hook structure 220 is disposed at the pivot end 184 of the body 182 and is unitary with the body or integrally connected with the body 182. The hook structure 220 can have a vertical member 222 that extends up from the top wall 196 of the body 182 at or adjacent the pivot end 184 thereof and a horizontal member 224 that extends longitudinally away from the vertical member 222 and the pivot end 184 of the body 182. The horizontal member 224 has a locking projection 226 that depends down from the horizontal member 224 so that it can engage the transverse slot 248 of the lock bar 230 when the pendulum 180 automatically rotates, due to gravity, toward the lock bar 230 to secure and retain it in the locked position, as illustrated in FIG. 5G. The horizontal member 224 includes an aperture 228 for receiving the lever 260 (FIGS. 5A-5D and FIGS. 5G-5I) that extends up from the hook structure 220 and through an elongated window $\mathbf{142}_W$ in the top wall $\mathbf{142}_T$ of the first brace member 142. The lever 260 is used by the golfer to pivot the pendulum 180 back into the locked position, as illustrated in FIG. 5G. The length of elongated window $\mathbf{144}_W$ in the top wall $\mathbf{144}_T$ of the second brace member 144 is set to stop the lock bar 230 at the point where the locking projection 226 of the hook structure 220 of the pendulum 180 engages the transverse slot 248 of the lock bar 230 to latch/lock the lock bar 230.

Figure 7A:
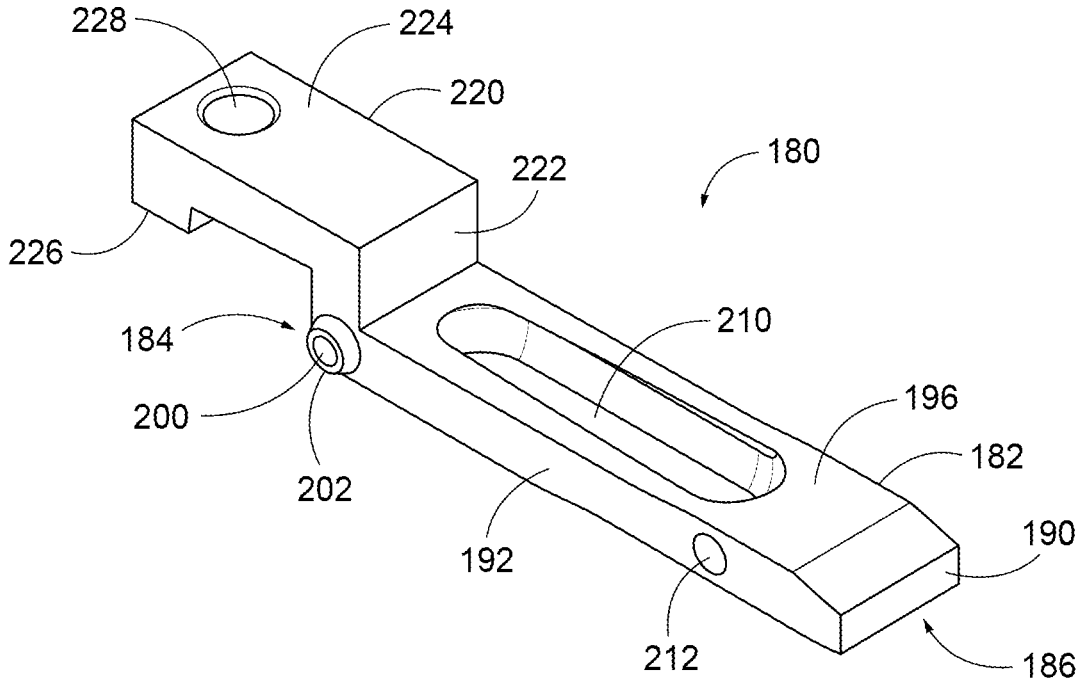
Figure 7B:
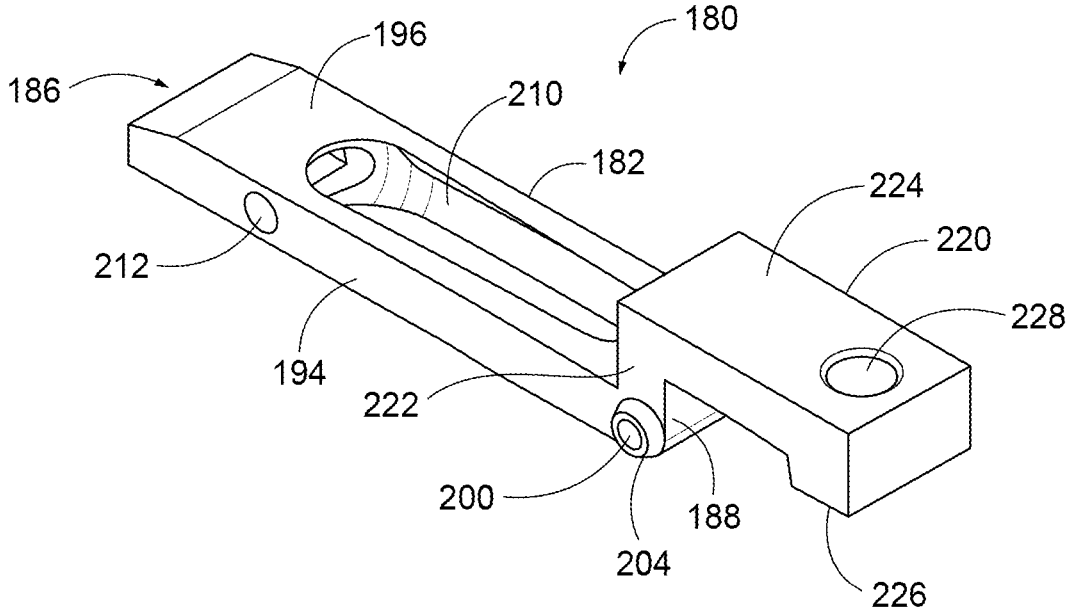
Figure 7C:
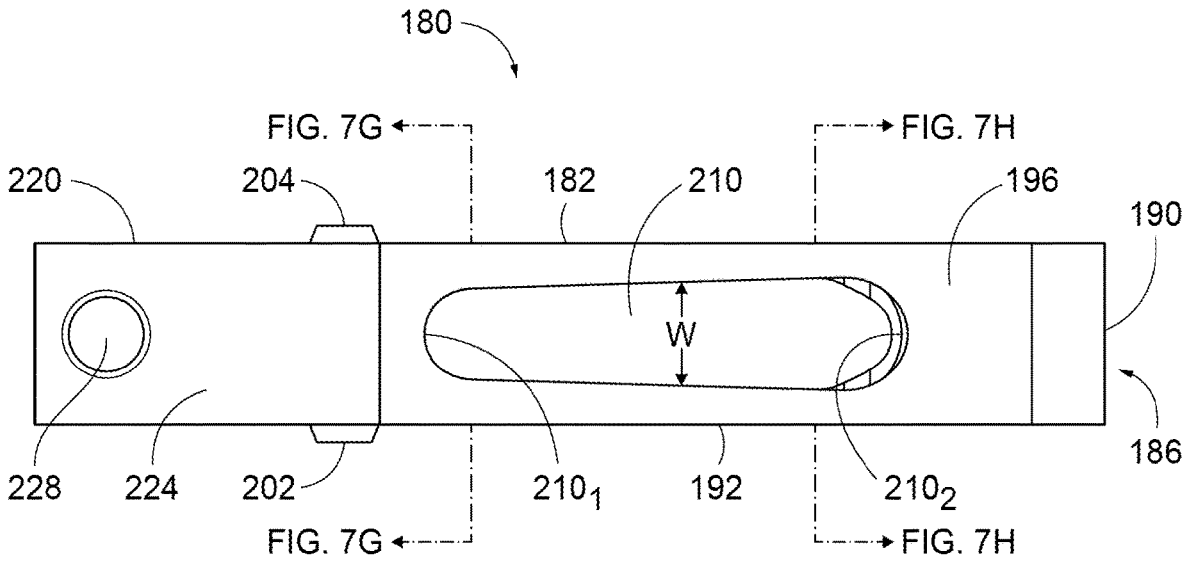
Figure 7D:
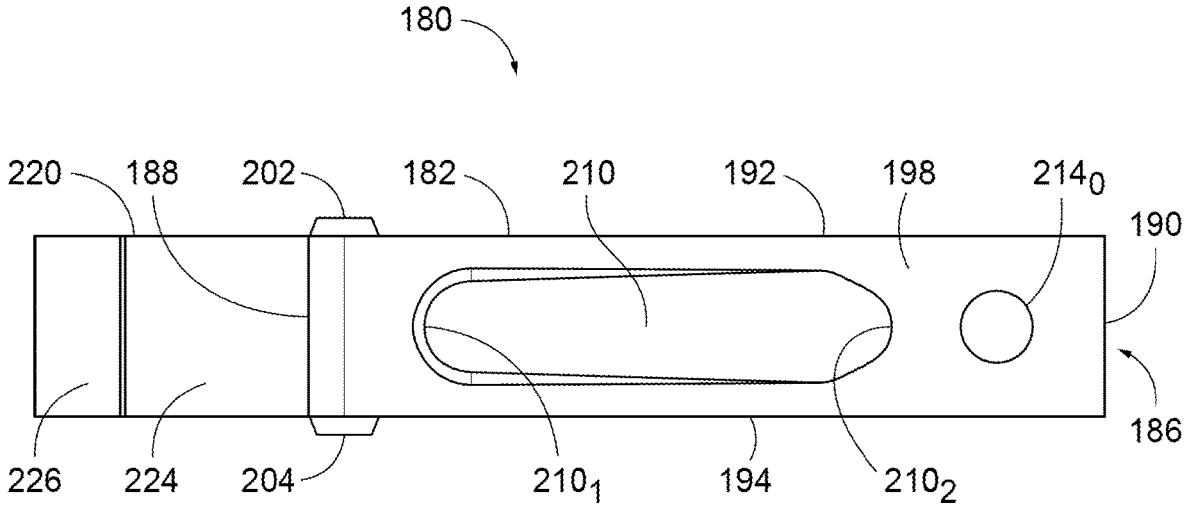
Figure 7E:
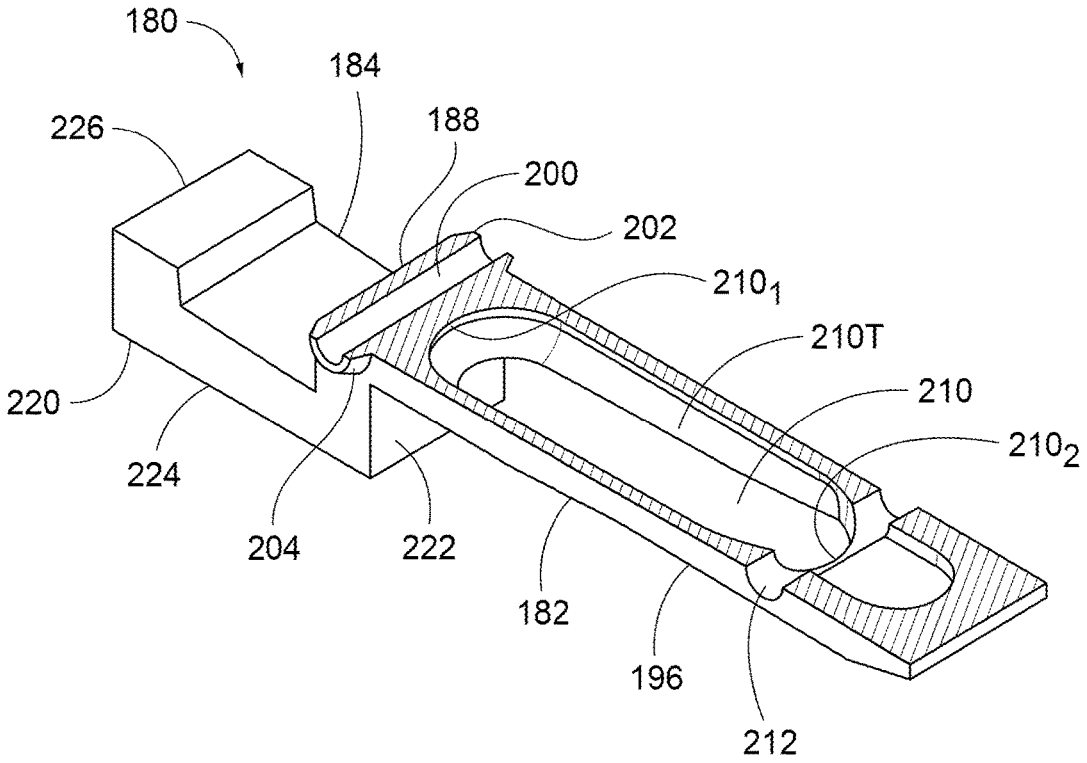
Figure 7F:
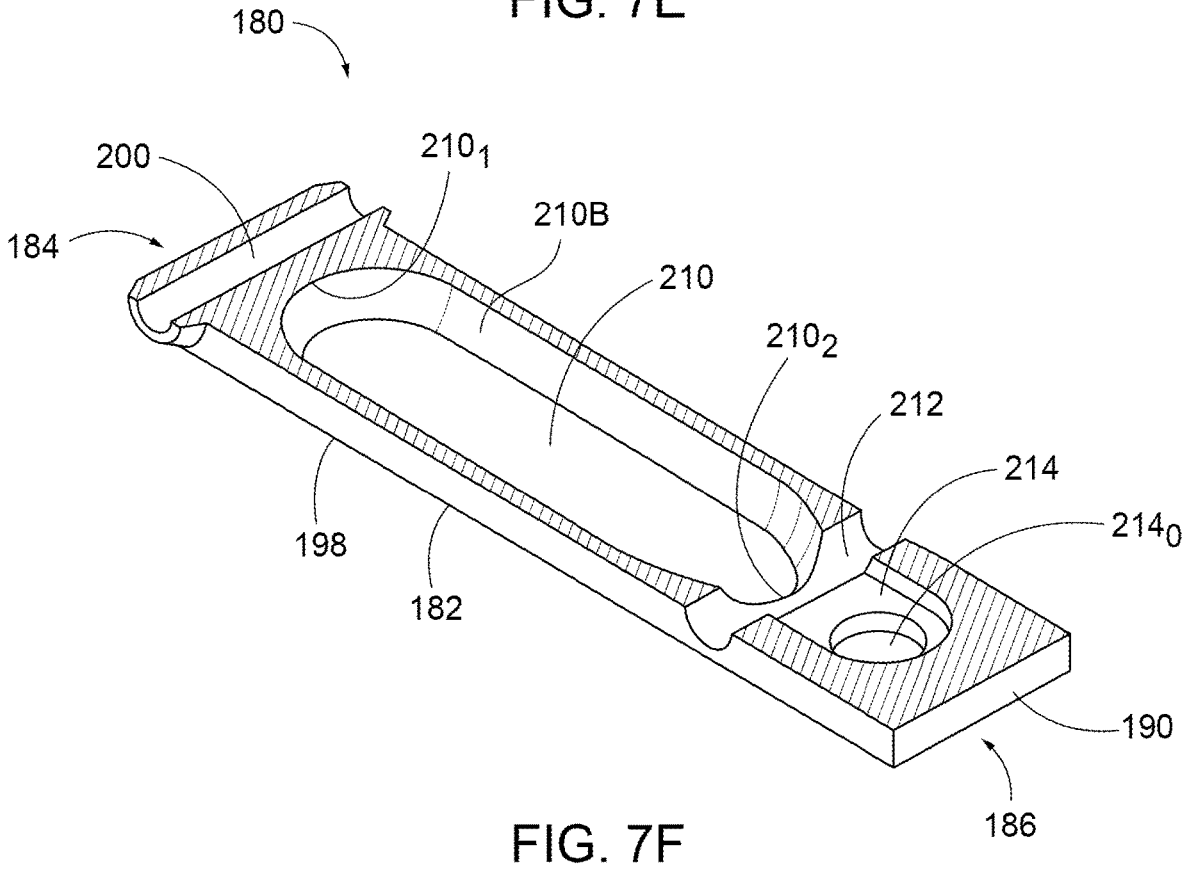
Figure 7G:
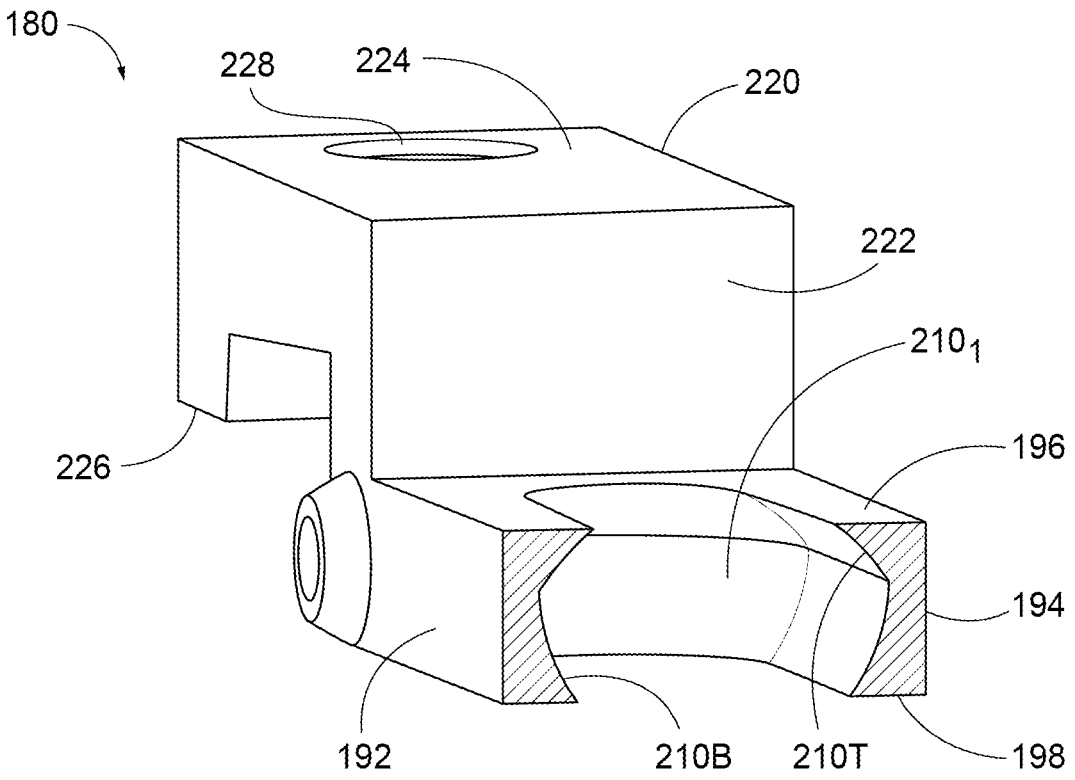
Figure 7H:
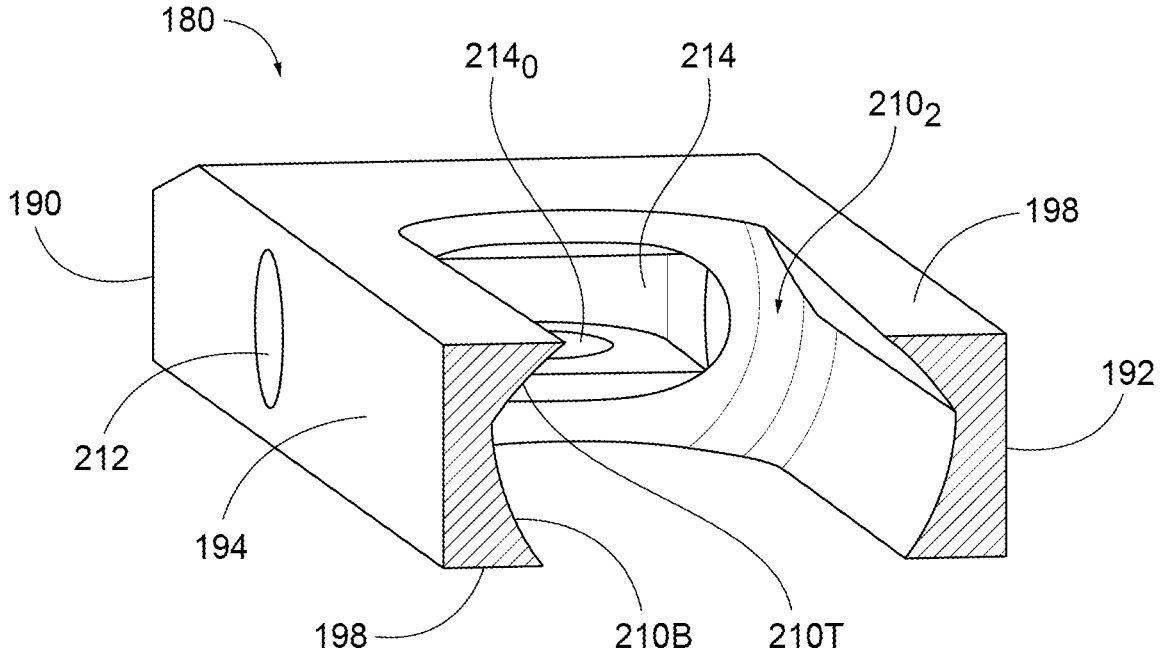

As collectively illustrated in FIGS. 7E-7H, the channel 210 has a top sidewall section $\mathbf{210}_T$ and a slightly larger bottom sidewall section $\mathbf{210}_B$. The bottom sidewall section $\mathbf{210}_E$ of the channel 210 has a generally spherical shape transverse cross-section (FIGS. 7F, 7G and 7H), which shape conforms with the spherical shape of the ball 216. The bottom sidewall section $\mathbf{210}_E$ of the channel 210 is dimensioned to allow the ball 216 to freely roll between the first and second ends $\mathbf{210}_1$, $\mathbf{210}_2$ of the channel 210 while preventing the ball 216 from falling out of the channel 210 through the opening thereof in the bottom wall 198 of the body 182. As illustrated in FIG. 7C, the top sidewall section $\mathbf{210}_T$ of the channel 210, at the second end $\mathbf{210}_2$ thereof, is dimensioned to allow the ball 216 to be installed into the channel 210 from the top of the pendulum body 182 during manufacturing of the pendulum 180. As the top sidewall section $\mathbf{210}_T$ of the channel 210 extends from the second end to the first end $\mathbf{210}_1$ thereof, the opening of the channel 210 in the top wall 196 of the body 182 gradually decreases in width W to prevent the ball from falling out through the opening of the channel 210 in the top wall 196 of the body 182. A lock pin aperture 212 (FIGS. 7E, 7F, and 7H), which extends transversely through the body 182 from the first side wall 192 to the second side wall 194 thereof, is provided just beyond the second end $\mathbf{210}_2$ of the channel 210 for receiving a lock pin (not shown). The lock pin aperture 212 is positioned in the body 182 with respect to the second end $\mathbf{210}_2$ of the channel 210, so that the second end $\mathbf{210}_2$ of the channel 210 opens into the lock pin aperture 212. Therefore, when the lock pin (not shown) is screw threaded or press-fitted into the lock pin aperture 212, after installation of the ball 216 through the channel opening in the top wall 196 of the body 182 at the second end $\mathbf{210}_2$ thereof, the lock pin partially extends into the second end $\mathbf{210}_2$ of the channel 210, thereby partially blocking it so that the ball 216 cannot roll all the way to the second end $\mathbf{210}_2$ of the channel 210 and fall out through the channel opening in the top wall 196 of the body 182 at the second end $\mathbf{210}_2$ thereof. A compartment 214 is provided within the body 182 between the lock pin aperture 212 and the second end 186 of the body 182 for receiving a magnetic force generating device, such as a permanent magnet (not shown). The bottom wall of the compartment has an opening $\mathbf{214}_O$ for allowing the magnetic force of the magnetic force generating device to attract the free end 186 of the pendulum body 182 to the bottom wall $\mathbf{142}_B$ of the first brace member 142 when the pendulum 180 pivots to the released or unlocked position, as illustrated in FIGS. 5H and 5I, and thereby retain the pendulum 180 in the released or unlocked position as the leading arm of the golfer travels upward on the final portion of the golf swing. As illustrated in FIGS. 1C and 1D, the hinge area H' of the elbow bracing assembly 140 remains accessible to the golfer due to the first and second brace members 142 and 144 being only partially disposed in the first and second pockets 36 and 37 of the sleeve 31. Therefore, the golfer can access the finger gripping element 252 of the lock bar 230 and the lever 260 of the pendulum and manually slide the lock bar 230 and rotate the pendulum 180 to place the elbow bracing assembly 140 in the locked mode prior to swinging the golf club.

Figure 9A:
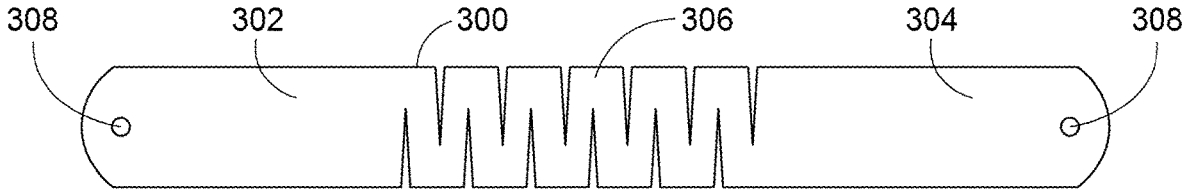
FIG. 9A is a top plan view of an exemplary embodiment of a base or platform on which the elbow bracing assembly of the present disclosure can be mounted.
Figure 9B:
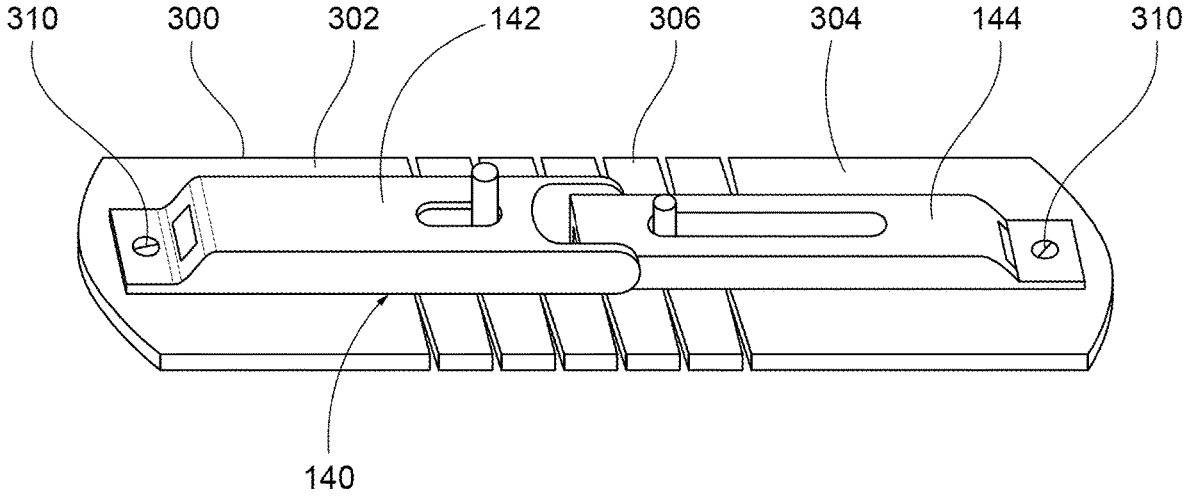
FIG. 9B is a top perspective view illustrating the elbow bracing assembly of FIGS. 5A-5I mounted on the platform of FIG. 9A.

FIG. 9A depicts an exemplary embodiment of a base or platform 300 upon which the elbow bracing assembly 40, 140 of the present disclosure can be mounted. The platform 300 can be made of a thin strip of flexible material, such as a polycarbonate material or a metal alloy material having a thickness ranging between 1/16 inches to 1/4 inches, and is operative to maintain the first and second brace members 42, 142 and 44, 144 in a desired location and an aligned position within the sleeve 31 (FIG. 2). The platform 300 comprises a unitarily formed member that includes a first mounting end section 302 for mounting the first brace member 42, 142 on, a second mounting end section 304 for mounting the second brace member 44, 144 on, and an intermediate spring section 306, which connects the first and second mounting sections 302 and 304 to one another and acts as a tension spring to compensate for the change in the instantaneous effective length of the elbow bracing assembly 40, 140, as the elbow bracing assembly 40, 140 pivots with the bending of the golfer's arm when the elbow bracing assembly is unlocked to allow the golfer to perform the upswing portion of the golf swing. The first and second mounting end sections 302 and 304 of the platform 300 each includes an aperture 308 for receiving a screw fastener. FIG. 9B depicts the elbow bracing assembly 140 of FIGS. 5A-5I mounted on the platform 300 and retained thereon using screw fasteners 310 received in the apertures 308 of the first and second mounting end sections 302 and 304 of the platform 300. Although not shown, the elbow bracing assembly 40 of FIGS. 3A-3F can be mounted on the platform 300 in a similar manner.

Prior to swinging the golf club, the golfer place his/her arm in the unbent position and uses the finger gripping element to manually slide the lock bar 230 of the elbow bracing assembly 140 toward the first brace member 142 and then uses the lever 260 to rotate the pendulum 180 toward the lock bar 230 to set the golf swing training device into the locked mode, as illustrated in FIGS. 5G and 8A. This positions the ball 216 at the first end $\mathbf{210}_1$ of the channel 210, to ensure reinforcement of the pendulum 180 in the locked position until such time that gravity G causes the ball 216 to roll within the channel 210 from the first end $\mathbf{210}_1$ thereof, toward the second end $\mathbf{210}_2$ thereof, as illustrated in FIG. 8B. The locked position of the pendulum 180, therefore, is maintained by gravity in such a way that the released or unlocked position will coincide with the downward position of the leading arm. With the elbow bracing assembly 140 of the device 20 in the locked mode, the device 20 maintains the elbow 14 of the golfer's leading arm 12 in the un-bent straight position as the golfer 10 raises the golf club 13 during the back-swing portion of the golf swing, as illustrated in FIG. 10A. The elbow bracing assembly 140 of the device 20 in the locked mode, maintains the elbow 14 of the golfer's leading arm 12 in the un-bent straight position, as the golfer 10 lowers the golf club 13 during the down-swing portion of the golf swing, as illustrated in FIG. 10B, and remains in the locked mode to maintain the elbow 14 of the golfer's leading arm 12 in the un-bent straight position, as the golfer 10 contacts the golf ball 15 with the head of the golf club 13, as shown in FIG. 10C. Just after contact with the golf ball 15 has been made with the head of the golf club 13, the pendulum automatically rotates away from the lock bar 230 of the elbow bracing assembly 140 due to gravity G, which causes the ball 216 to roll within the channel 210 from the first end $\mathbf{210}_1$ thereof, toward the second end $\mathbf{210}_2$ thereof, as illustrated in FIG. 8B, thus releasing the lock bar 230, as illustrated in FIG. 5H. Gravity G acts on the released lock bar 230 and causes it to slide completely into the second brace member 144 in the unlocked position, as illustrated in FIG. 5I Once the lock bar 230 is completely contained in the second brace member 144, the first and second brace members 142 and 144 can pivot at hinge 146 as the elbow 14 of the golfer's leading arm 12 bends so that the golfer 10 can perform the up-swing portion of the golf swing, as illustrated in FIG. 10D.

Although the golf swing training device has been described in terms of illustrative embodiments, it is not limited thereto. Rather, the appended claims should be construed broadly to include other variants and embodiments of same, which may be made by those skilled in the art without departing from the scope and range of equivalents of the golf swing training device.

What is claimed is:

1. A golf swing training device comprising:

a sleeve or strap arrangement to be worn about the elbow of a leading arm of the golfer; and an elbow bracing assembly attached to or integrated with the sleeve or strap arrangement, the elbow bracing assembly comprising:

first and second brace members pivotally connected with a hinge in a hinge area defined by the first and second brace members; and a lock bar slidable within at least a portion of the first and second brace members between a locked position and an unlocked position, the lock bar in the locked position extending across the hinge area and having a first portion disposed within the first brace member and a second portion disposed within the second brace member, thereby substantially preventing pivotal movement of the first and second brace members, and the lock bar in the unlocked position completely disposed within the second brace member; and a gravity activated pendulum pivotally mounted within the first brace member, the pendulum being rotatable between first and second positions, the pendulum in the first position engaging and retaining the lock bar in the locked position, the pendulum in the second position being disengaged from the lock bar;

wherein the lock bar of the elbow bracing assembly in the locked position, allows the device to stay substantially unbent, thereby substantially preventing bending of the elbow of the leading arm during a back-swing and down-swing portions of a golf swing; and wherein the lock bar of the elbow bracing assembly in the unlocked position, allows the device to bend with bending of the elbow of the leading arm during an up-swing portion of the golf swing.

2. The golf swing training device of claim 1, wherein the lock bar automatically slides into the unlocked position near the end of the down-swing portion of a golf swing.

3. The golf swing training device of claim 1, further comprising a first magnetic force generating device disposed in the first brace member for retaining the lock bar in the locked position.

4. The golf swing training device of claim 3, wherein the first magnetic force generating device releases the lock bar and allows the lock bar to slidably move into the unlocked position due to a centrifugal force generated on the lock bar during the down-swing portion of the golf swing.

5. The golf swing training device of claim 4, further comprising a second magnetic force generating device disposed in the second brace member for retaining the lock bar in the second position.

6. The golf swing training device of claim 3, wherein the lock bar includes an adjustment member for adjusting a magnetic attractability of the lock bar to the first magnetic force generating device.

7. The golf swing training device of claim 1, wherein the pendulum automatically rotates via gravity from the first position to the second position to release the lock bar so the lock bar can freely slide into the unlocked position.

8. The golf swing training device of claim 7, further comprising a ball rollingly disposed within an elongated channel formed in the pendulum.

9. The golf swing training device of claim 8, wherein the pendulum comprises a body and a hook structure, the body having the elongated channel containing the ball and the hook structure for engaging the lock bar and retaining the lock bar in the locked position.

10. The golf swing training device of claim 9, the body having a pivot end and a free end disposed opposite the pivot end, the channel having a first end marginally adjacent the pivot end of the body and a second end marginally adjacent the free end of the body, wherein the ball at the first end of the channel aids in holding the pendulum in the first position to retain the lock bar in the locked position and wherein the ball aids the pendulum in rotating from the first position to the second position as the ball rolls within the channel from the first end thereof to the second end thereof during rotation of the pendulum.

11. The golf swing training device of claim 10, further comprising a magnetic force generating device disposed within the body of the pendulum at a location marginally adjacent to the free end of the body, the magnetic force generating device being operative for holding the pendulum in the second position until the pendulum is manually rotated back to the first position.

12. The golf swing training device of claim 11, further comprising a lever for allowing a user to manually rotate the pendulum back to the first position.

13. The golf swing training device of claim 11, further comprising a finger gripping element for allowing a user to manually slide the lock bar back toward the first brace member so that it can be retained in the locked position by the pendulum.

14. The golf swing training device of claim 1, further comprising a finger gripping element for allowing a user to manually slide the lock bar back toward the first brace member so that it can be retained in the locked position by the pendulum.

15. The golf swing training device of claim 1, further comprising a ball rollingly disposed within an elongated channel formed in the pendulum.

16. The golf swing training device of claim 1, wherein the pendulum comprises a body and a hook structure, the hook structure for engaging the lock bar and retaining the lock bar in the locked position.

17. The golf swing training device of claim 1, wherein the lock bar includes a slot for receiving a hook structure of the pendulum when the pendulum is in the first position engaging and retaining the lock bar in the locked position.

18. A golf swing training device comprising:

a sleeve or strap arrangement to be worn about the elbow of a leading arm of the golfer; and an elbow bracing assembly attached to or integrated with the sleeve or strap arrangement, the elbow bracing assembly comprising:

first and second brace members pivotally connected with a hinge in a hinge area defined by the first and second brace members; and a lock bar slidable within at least a portion of the first and second brace members between a locked position and an unlocked position, the lock bar in the locked position extending across the hinge area and having a first portion disposed within the first brace member and a second portion disposed within the second brace member, thereby substantially preventing pivotal movement of the first and second brace members, and the lock bar in the unlocked position completely disposed within the second brace member; and a platform, upon which the elbow bracing assembly is mounted, the platform including a tension spring for compensating for a change in a length of the elbow bracing assembly, as the elbow bracing assembly pivots with the bending of the elbow of the leading arm during the up-swing portion of the golf swing;

wherein the lock bar of the elbow bracing assembly in the locked position, allows the device to stay substantially unbent, thereby substantially preventing bending of the elbow of the leading arm during a back-swing and down-swing portions of a golf swing; and wherein the lock bar of the elbow bracing assembly in the unlocked position, allows the device to bend with bending of the elbow of the leading arm during an up-swing portion of the golf swing.

19. The golf swing training device of claim 1, further comprising a magnetic force generating device disposed within the body of the pendulum at a location marginally adjacent to the free end of the body, the magnetic force generating device being operative for holding the pendulum in the second position until the pendulum is manually rotated back to the first position.

* * * * *